US008752496B2

(12) United States Patent
Coppens

(10) Patent No.: US 8,752,496 B2
(45) Date of Patent: Jun. 17, 2014

(54) SEMI-SUBMERSIBLE VESSEL, METHOD FOR OPERATING A SEMI-SUBMERSIBLE VESSEL AND METHOD FOR MANUFACTURING A SEMI-SUBMERSIBLE VESSEL

(75) Inventor: Ton Coppens, Oegstgeest (NL)

(73) Assignee: Heerema Marine Contractors Nederland SE, Leiden (NL)

( * ) Notice: Subject to any disclaimer, the term of this patent is extended or adjusted under 35 U.S.C. 154(b) by 150 days.

(21) Appl. No.: 12/280,041

(22) PCT Filed: Dec. 12, 2006

(86) PCT No.: PCT/NL2006/000635
§ 371 (c)(1),
(2), (4) Date: Aug. 20, 2008

(87) PCT Pub. No.: WO2007/097611
PCT Pub. Date: Aug. 30, 2007

(65) Prior Publication Data
US 2010/0224114 A1 Sep. 9, 2010

(51) Int. Cl.
*B63B 35/44* (2006.01)

(52) U.S. Cl.
USPC ..... 114/265

(58) Field of Classification Search
USPC ..... 114/264, 265
See application file for complete search history.

(56) References Cited

U.S. PATENT DOCUMENTS 1,757,174 A 5/1930 Douglas
3,447,502 A * 6/1969 Leopold ..... 114/61.14
(Continued)

FOREIGN PATENT DOCUMENTS

AU 443065 B 11/1973
AU 2003290202 A1 6/2004
(Continued)

OTHER PUBLICATIONS

Heerema, P.S., "Developments in Crane Barges," Paper presented at the Seminar on Module Handling for Offshore Oil and Gas Platforms, pp. 28-31, Oct. 6, 1977.

(Continued)

*Primary Examiner* — Edwin Swinehart
(74) *Attorney, Agent, or Firm* — Hoffmann & Baron, LLP

(57) ABSTRACT

The present invention relates to a semi-submersible vessel comprising at least one lower hull section (22) which defines a first water displacing volume; a support structure (24) connected to the at least one lower hull section (22) and extending upward from the at least one lower hull section, wherein the support structure (24) has a waterplane area which is substantially smaller than the waterplane area of the at least one lower hull section; a deck structure (26) connected to the support structure (24), wherein the deck structure (26) is provided at a distance above the at least one lower hull section (22); a ballast system for controllably varying the draft of the vessel such that at a first draft (30) the at least one lower hull section (22) may be provided at least in part above the water-line and at a second draft (28) the support structure may be provided at least partly below the water-line; wherein the assembly of said at least one lower hull section, said support structure and said deck structure comprises structural reinforcements, such that the vessel is sufficiently strong to substantially safely survive a storm at the first draft (30). The invention further relates to a method of operating such a semi-submersible vessel.

15 Claims, 15 Drawing Sheets

(56) References Cited

U.S. PATENT DOCUMENTS

| | | | | | |
|---|---|---|---|---|---|
| 3,490,406 | A | | 1/1970 | O'Reilly et al. | |
| 3,610,193 | A | | 10/1971 | Lacy et al. | |
| 3,685,305 | A | | 8/1972 | Lloyd, Iii | |
| 3,763,809 | A | | 10/1973 | Pazos | |
| 3,872,814 | A | * | 3/1975 | Rodriguez | 114/40 |
| 4,015,552 | A | | 4/1977 | Korkut | |
| 4,232,625 | A | * | 11/1980 | Goren et al. | 114/264 |
| 4,361,104 | A | | 11/1982 | Lloyd, III et al. | |
| 4,380,406 | A | * | 4/1983 | Ayers | 405/206 |
| 4,385,583 | A | * | 5/1983 | Ayers | 114/265 |
| 4,440,103 | A | * | 4/1984 | Lang | 114/61.14 |
| 4,646,672 | A | * | 3/1987 | Bennett et al. | 114/264 |
| 4,984,935 | A | * | 1/1991 | de Oliveira Filho et al. | 405/224 |
| 6,182,593 | B1 | * | 2/2001 | Wierick | 114/249 |
| 6,378,451 | B1 | | 4/2002 | Wetch et al. | |
| 6,935,810 | B2 | * | 8/2005 | Horton, III | 405/200 |

FOREIGN PATENT DOCUMENTS

| | | | |
|---|---|---|---|
| FR | 2847225 | A1 | 5/2004 |
| GB | 2137578 | A | 10/1984 |
| NL | 7907448 | A | 4/1981 |

OTHER PUBLICATIONS

Rohmaller, Paul L., "A Pipelay/Derrick Barge Designed for Rough Seas," Offshore Technology Conference, Paper OTC 2509, pp. 907-918, May 3, 1976.

* cited by examiner 1a
8
4
1a 1a
13
4
6
9
7
9
2
10
3
9
11
5
6
16
8
13
14
10
3
33
17
2
6
10
4
1a
9
12
9
7
5
11

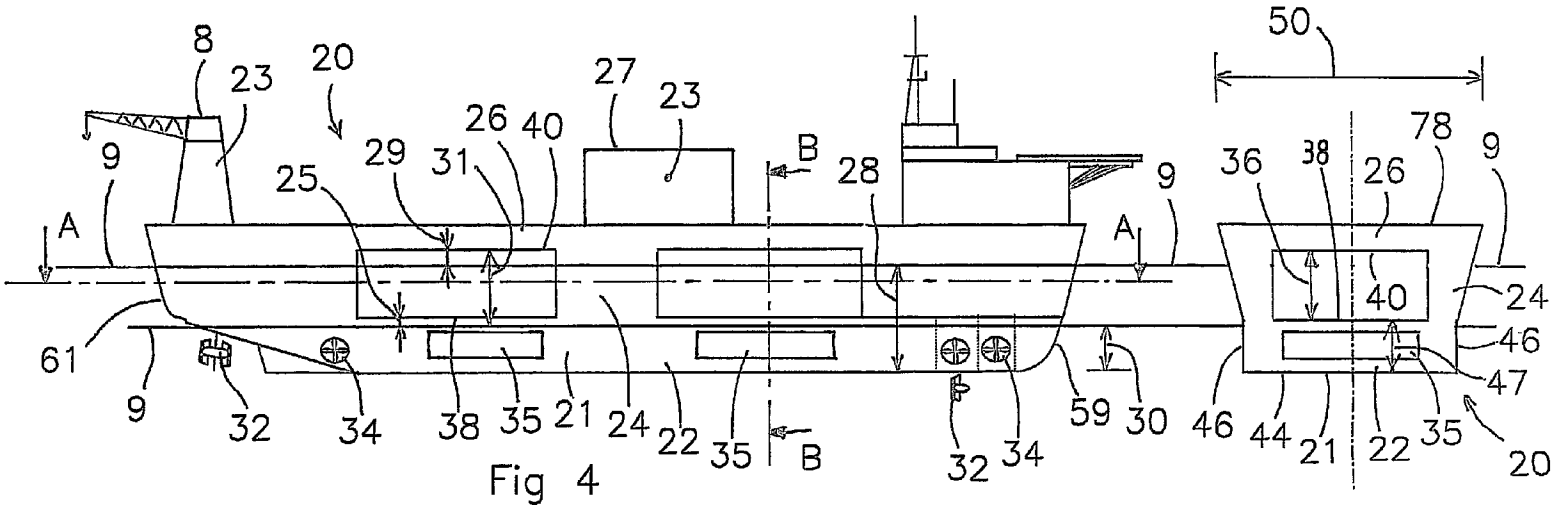
Fig 6
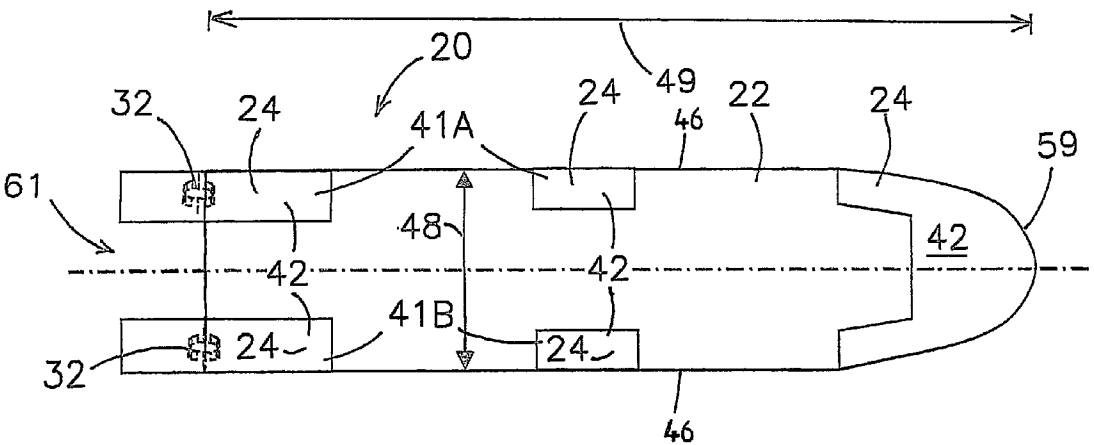
Fig 5
Fig 4

60
59
46
22
46
20
32
32
62
61
26

SEMI-SUBMERSIBLE VESSEL, METHOD FOR OPERATING A SEMI-SUBMERSIBLE VESSEL AND METHOD FOR MANUFACTURING A SEMI-SUBMERSIBLE VESSEL

CROSS-REFERENCE TO RELATED APPLICATIONS

This application is the National Stage of International Application No. PCT/NL2006/000635, filed Dec. 12, 2006, which claims the benefit of International Application No. PCT/NL2006/000099, filed Feb. 27, 2006, the contents of which is incorporated by reference herein.

FIELD OF THE INVENTION

The present invention relates to a semi-submersible vessel. The invention further relates to a method for operating a semi-submersible vessel and to a method for manufacturing a semi-submersible vessel.

BACKGROUND OF THE INVENTION

Semi-submersible vessels are known in the field of the art, and are widely used in the offshore industry, in particular for construction operations at sea, such as pipeline laying, pile driving, module installation, and other operations. Semi-submersible vessels are particularly used for the exploration, preparation and exploitation of oil and gas fields. The word 'semi-submersible' indicates that the vessel has a variable draft, which draft is controllable.

Offshore operations generally require a vessel that is stable in conditions with waves.

Prior to the advent of semi-submersible vessels, ship-shape vessels were used for offshore operations. The words 'ship-shape' indicate that this vessel has a 'normal' hull shape, in the sense that at an intersection plane where the hull intersects the water-line, the cross-sectional area of the hull, when viewed from above, is substantially the same as the surface area of the hull below the water-line. A ship-shape vessel advantageously has a relatively large allowable ratio of deadweight to displacement at operational draft, which allows it to carry a substantial deckload and a substantial amount of equipment on deck.

TERMINOLOGY

The displacement of a vessel is the actual weight of the vessel and its contents. The displacement gives an indication of the size of the vessel.

The deadweight is the maximum weight that a ship can safely carry when fully loaded. It includes the cargo, fuel, water, crew and stores. Fixed equipment, such as heavy cranes, a drilling rig and a pipelay tower are formally part of the ship and not of the deadweight.

The words 'deckload and equipment' (or deckload & equipment) are used to indicate the combined weight of the cargo positioned on the deck and the equipment which is positioned on the deck and fixed to the vessel, which equipment may comprise: one or more cranes, a drilling rig and a pipelay tower. Other equipment may also be provided.

A ship-shape vessel advantageously has a relatively large ratio of 'deckload & equipment' to displacement at transit draft, typically at least 0.3. Another advantage of a ship-shape vessel is its relatively high maximum speed, typically being 12 to 25 knots.

The position of the deckload & equipment relative to the vessel influences the stability of the vessel. If the deckload & equipment is positioned relatively high, the stability of the vessel may drop below a required minimum stability.

The ratio of deckload and equipment to displacement, used further here, gives an indication of the efficiency of the vessel to carry a load. A high ratio indicates that a relatively small vessel can carry a relatively large load.

DESCRIPTION OF THE PRIOR ART

Ship-shape vessels may have a relatively cumbersome dynamic behaviour in certain conditions. This is due to the fact that when viewed from above, the waterline area of the vessel is relatively large, which makes the ship-shape vessel sensitive to wave forces, resulting in relatively large roll, pitch and heave motions of the vessel.

A measure that is known in the field of the art to reduce the roll, pitch and heave motions is to orient a bow of the vessel in a particular direction during an operation, i.e. weathervaning, in order to reduce forces from waves on the vessel However, long waves also known as 'swell waves', generated by far distant storms, may be encountered from different directions at the same time as the local generated wind driven seas, and wind and current forces may yaw the vessel into an angle with the incoming waves, limiting the positive effect of weathervaning. Further, weathervaning of a vessel generally has other disadvantages, for instance in a situation wherein a particular orientation of the vessel is required in view of an operation which is to be carried out, e.g. a pipeline laying or a drilling operation.

Wind, wave and current are however not always uni-directional and swells and wind driven seas may be encountered from different directions, limiting the effect of weathervaning the monohull, which effect in relative severe motions and high downtime of this monohull type of vessel.

Therefore, ship-shape vessels are less suitable for many offshore operations in regions where severe storms may occur, i.e. the North Sea or North Atlantic.

Semi-submersible vessels have been developed in the past 40 years. One of the first semi-submersible vessels for construction operations, the Semac I, is disclosed in "A Pipelay/Derrick Barge Designed for rough seas" by Rohmaller in OTC2509 of 1976. The article "Developments in crane barges" by P. S. Heerema in 1977 provides a clear disclosure of the relevant aspects related to ship-shape vessels and the advantages of semi-submersible vessels. Semi-submersibles have replaced ship-shape vessels for a wide variety of offshore operations in recent years.

A first type of semi-submersible vessel comprises two or more lower flotation bodies (also known as pontoons), a support structure extending upwards from the pontoons and a deck which has an underside which is provided at a distance from the pontoons. Generally, the deck extends substantially horizontally. The support structure may comprise several support columns, which are spaced apart horizontally, in order to provide a clearance between the support columns.

The height of the support structure is chosen such, that waves are substantially prevented from hitting the deck and thereby imparting relatively large forces on the deck.

In a storm condition, the waves are high and the installation equipment, i.e. cranes, will not be used but secured in a stowed position. A large clearance (storm clearance) is to be provided between the water-line and the deck during a storm. The storm draft is thus relatively small.

Because the two flotation bodies are separate constructions, known semi-submersibles of this first type generally have a low strength. If such a semi-submersible vessel is positioned with the flotation bodies partly above the water-line during a storm, the hull is generally not strong enough to stay undamaged during exposure to the wave forces.

Therefore, during a storm known semi-submersibles have the flotation bodies entirely under water and well below the water-line in order to reduce the wave forces. Therefore, the support structure must be relatively high to create sufficient clearance to the underside of the deck for high waves.

An example of such a vessel is disclosed in AU 443 065 which discloses on page 16 and 17 that in high waves the vessel is submerged to approximately one-half the effective height of the columns between the flotation body and the deck structure. In this way, both the flotation body and the deck structure are free of wave action.

This results in a serious disadvantage of known semi-submersible vessels, i.e. with the cargo and the installation equipment usually positioned on deck, the position of the centre of gravity of a large semi-submersible is relatively high, which negatively influences stability.

During transport, it is important that a relatively high speed can be attained. The transport draft of the vessel should be relatively small to minimise the wet surface of the semi-submersible, thereby minimising frictional resistance on the semi-submersible.

However, known semi-submersible vessels having two flotation bodies have a large wet surface and for this reason, these types of semi-submersible vessels generally have a relatively low maximum speed, e.g. 6-8 knots.

A second type of semi-submersible vessel exists with only one pontoon. This second type of semi-submersible vessel has a higher maximum speed and is discussed in OTC 3296 by De Vries, Kaldenbach and Suyderhoud in "Design construction and workability of a semi-submersible derrick barge with 2000 tons revolving crane" in 1978.

Another example is disclosed in U.S. Pat. No. 3,610,193.

This type of semi-submersible is also designed to ride out a storm with the pontoon below the water level and therefore also has a relatively high deck. Like the first type of semi-submersible, this second type of semi-submersible vessel thus also has a relatively small allowable ratio of deckload & equipment to displacement, i.e. a ratio of 0.1. The combined allowable deckload and fixed installation equipment, or 'deckload & equipment', is thus limited for existing semi-submersibles. Typically, for known semi-submersible vessels positioned at a storm draft, the ratio of 'deckload & equipment' to displacement is limited to about 0.10.

SUMMARY OF THE INVENTION

It is an object of the invention to provide a semi-submersible vessel which suffers less from at least one of the above mentioned drawbacks.

It is another object of the invention to provide a semi-submersible vessel, which has a relatively high ratio of deckload and equipment to displacement.

It is another objective of the present invention to provide a semi-submersible vessel, which is relatively fast in comparison with known semi-submersible vessels.

It is another objective of the present invention to provide a semi-submersible vessel, which has a relatively small minimum draft, in order to have access to harbours with a limited water depth.

At least one of these objectives is reached in a semi-submersible vessel comprising:

- at least one lower hull section which defines a first water displacing volume;
- a support structure connected to the at least one lower hull section and extending upward from the at least one lower hull section, wherein the support structure has a water-plane area which is substantially smaller than the water-plane area of the at least one lower hull section;
- a deck structure connected to the support structure, wherein the deck structure is provided at a distance above the at least one lower hull section;
- a ballast system for controllably varying the draft of the vessel such that at a first draft the at least one lower hull section may be provided at least in part above the water-line and at a second draft the support structure may be provided at least partly below the water-line;

wherein the assembly of said at least one lower hull section, said support structure and said deck structure comprises structural reinforcements, such that the vessel is sufficiently strong to substantially safely survive a storm at the first draft.

The vessel of the invention is designed to be positioned at the first draft for a storm condition with high significant wave heights, and to 'ride' the storm waves at this first draft.

At the first draft, the at least one lower hull section intersects the water-line and causes the hull of the vessel of the invention to have a form of a ship-shape vessel at and below the water-line. It is inherent to the invention that the vessel according to the invention will experience higher roll, pitch and heave motions during a storm than the vessel of the prior art, because the at least one lower hull section is positioned in part above the water level during the storm, increasing the wave forces onto the at least one lower hull section.

The words 'at least one lower hull section' indicate that there may be a single lower hull section, two lower hull sections, or more lower hull section. If a single lower hull section is provided, it may have the form of a 'ship-shape' hull or any other suitable form.

If two or more flotation bodies are provided, they may have the form of a the shape and size of a hull of a known semi-submersible or a different shape and/or size.

The words 'support structure' indicate that this part of the vessel supports the deck structure. The support structure may be a section of the hull, the section being integrally connected to the lower hull section.

The structural reinforcements may comprise a rigid portal connecting the at least one lower hull section, the support structure and the deck structure to one another.

The structural reinforcements may comprise bulkheads with increased strength, or a smaller spacing between the bulkheads, i.e. a greater number of bulkheads. Additionally or as a separate measure, the thickness of the walls of the hull of the vessel may be increased. Other technical means are also possible to reduce fatigue damage at the column deck intersection e.g. using haunch supports.

The vessel of the invention is designed against a prevailing belief in the field of the art that during a storm condition, the at least one lower hull section is to be positioned under the water-level. This belief relates to the notion that a pontoon of a semi-submersible is not strong enough to survive a storm when exposed to the full force of storm waves hitting the pontoon. Further, this belief is based on the idea that movements of the vessel during a storm will be too strong to be acceptable. AU 443 065 is a clear example of this prevailing belief.

Although it is generally known in maritime engineering that a lower centre of gravity of a vessel improves the stability, the combined requirement of a submerged position of the flotation bodies and a large clearance between the deck and the water-line results in a relatively high vessel, having a low ratio of 'deckload & equipment' to displacement.

In the present invention, it was found that the issue of insufficient strength may be resolved by structural improvements in the hull structure.

The invention is thus based on the insight that one or more flotation bodies may be constructed strong enough to be positioned in part above the water-line during a storm. This allows a smaller height of the support structure, which provides an advantageous feature in terms of a higher ratio of 'deckload & equipment' to displacement.

A surprising advantage appears in that the structural reinforcements increase the total amount of material, i.e. steel, which is used and thus increase the total mass of the vessel. However, due to the lower height of the support structure, a saving on material is achieved. The saving may be larger than the extra needed material, resulting in a lighter vessel.

The invention is further based on the insight that the occurring movements of a semi-submersible in a storm when the at least one lower hull section intersects the water-line are within acceptable boundaries.

The relatively small distance between the at least one lower hull section and the deck structure according to the invention provides a relatively low centre of gravity of the deck load and the equipment on deck. The smaller height of the support structure thus results in an increased allowable ratio of 'deckload & equipment' to displacement, because a lower centre of gravity of the 'deckload & equipment' allows more 'deckload & equipment' at a same stability of the vessel in comparison with known semi-submersible vessels.

The support structure may be connected to the at least one lower hull section at an upper side of the at least one lower hull section. At the storm draft, the support structure is thus positioned entirely above the water-line.

The distance between the at least one lower hull section and the deck structure may be determined from an underside of the deck structure to an upper side of the at least one lower hull section. This distance may vary, for instance because the underside of the deck structure is not completely horizontal or the upper side of the at least one lower hull section is not completely horizontal. In this case, an average distance between the at least one lower hull section and the deck structure may be determined, and taken as a criterion.

Generally, during an operation of the semi-submersible vessel, the draft, heel and trim are kept at a constant level by ballasting. However, in some situations, it may be preferable to vary the draft of the vessel during an operation.

The semi-submersible vessel of the invention may be configured as a survey, drilling, pipelay or installation vessel. The support structure may comprise at least two or more support columns, each provided as closed structures contributing to the stability of the semi-submersible.

The at least one lower hull section is generally elongate. The at least one lower hull section may also be referred to as a pontoon. The at least one lower hull section comprises reinforcement means configured for providing strength to the at least one lower hull section, such that the at least one lower hull section is capable of withstanding forces due to storm waves hitting the at least one lower hull section, with the vessel at the first draft.

In one aspect, the support structure defines one or more openings between the deck structure and the at least one lower hull section for allowing at least a part of a wave to pass substantially through the one or more openings without hitting the vessel when the vessel is positioned at the second draft. This reduces the forces of waves on the support structure.

In one aspect, the assembly of said at least one lower hull section, said support structure and said deck structure is sufficiently strong, such that when the vessel is positioned at the first draft the vessel can substantially safely survive a storm with an amount of deckload and/or equipment equal to at least 0.15 times a displacement of the vessel, preferably at least 0.2 times the displacement of the vessel.

This ratio allows the vessel to carry a substantial load. The ratio can be achieved by choosing the size and shape of the hull, in particular of the lower hull section, large enough and/or choosing the distance between the lower hull section and the deck structure small enough. Other factors also play a role.

In one aspect of the invention, the distance between the lower hull section and the deck structure is more than 12 meter and less than 18 meter. The dimension provide a suitable configuration for operation in known conditions at open sea.

In one aspect of the invention, the vessel is configured to have a natural heave period larger than 6 seconds and smaller than 14 seconds at the first draft. With this natural heave period and large waterplane area the vessel will heave substantially in long waves, in other words: the vessel substantially follows the waves. In another aspect of the invention, the vessel is configured to have a natural heave period larger than 8 seconds and smaller than 12 seconds at the first draft.

In one aspect of the invention, the vessel is configured to have a natural heave period larger than 14 seconds at the second draft. Preferably, the vessel is configured to have a natural roll and pitch period larger than 14 seconds at the second draft. These characteristics allow a relatively stable working environment when the vessel performs an operation at the operational draft.

In one aspect of the invention, the at least one lower hull section is configured as a single body. A single structure of the at least one lower hull section allows an increased strength of the vessel in comparison with vessels having two or more separate flotation bodies positioned substantially alongside one another.

In one aspect of the invention, the at least one lower hull section, the support structure and the deck structure together form a box-like shape, advantageously providing strength to the vessel. The single lower hull section forms a unitary underside of the box-like structure.

In one aspect, the assembly of said at least one lower hull section, said support structure and said deck structure is sufficiently strong, such that when the vessel is positioned at the first draft the vessel can substantially safely survive a winter storm in regions where severe storms may occur, i.e. the North Sea or North Atlantic, with an amount of deckload and/or equipment equal to at least 0.15 times the displacement. If the vessel is capable of surviving these storms, it may be operated in most parts of the world. Such severe storms are meteorologically defined as being a 10 on the Beaufort scale, typically having a wind speed of at least 89 to 102 km/h and a wave height of at least 9 to 12.5 meters.

In one aspect of the invention, the vessel is suitable for use in an offshore operation, in particular suitable for an operation chosen from a group of operations, comprising: a survey operation, a drilling operation, a well work-over operation, an installation operation, a preparation operation of an oil and gas field and an exploitation operation of an oil and gas field.

Because these operations are often conducted in a location where wind driven waves and swell waves are present, the semi-submersible according to the invention is particularly suitable for these conditions.

In one aspect of the invention, the vessel comprises at least one auxiliary hull section positioned at a distance above the at least one lower hull section, the auxiliary hull section having a waterplane area which is substantially greater than the waterplane area of the support structure, the vessel being movable to a third draft, at which a part of the auxiliary hull section is below the water line and a part of the auxiliary hull section is above the water-line.

The auxiliary hull section has an effect in that the natural heave period of the vessel at the third draft, i.e. when the auxiliary hull section is partly submerged, is substantially smaller than the natural heave period at the second draft, i.e. when the support structure is in the water-line and the at least one lower hull section is below the water-line. This is due to the fact that the waterplane area of the auxiliary hull section is greater than the waterplane area of the support structure.

Typically, at the second draft the heave period is 25 seconds.

The auxiliary hull section has a waterplane area which is large enough to significantly reduce the heave period at the third draft in comparison with the heave period at the second draft. At the third draft, the heave period may be 10 seconds, preferably even less than 8 seconds.

Swell waves typically have a natural periods of approximately 16 seconds. A vessel with a natural heave period of 25 seconds may resonate with these swell waves, resulting in less favourable dynamic behaviour.

The combination of swell waves having periods of approximately 16 seconds and a vessel with a heave period of less than 10 seconds results in less resonance in response to swell waves, and thus better dynamic behaviour.

The auxiliary hull section also provides extra stability and buoyancy when a very high load is to be lifted and/or supported.

Several auxiliary hull sections may be provided. The words 'auxiliary hull section' may also be understood as 'upper hull section'.

The auxiliary hull section may be provided separate from the deck structure or integral with the deck structure.

It will be clear to a person skilled in the art that structural elements of the vessel, e.g. a steel frame of the deck structure, also provide buoyancy.

It will be clear to a person skilled in the art that the ballast system will be configured to lower the vessel to a depth at which the auxiliary hull section is at least partly submerged. This may involve filling one or more ballast tanks in the lower hull section with water and filling one or more ballast tanks in the support structure and/or the auxiliary hull section with water.

Typically, the upper deck surface will be positioned above the auxiliary hull section so that the deck surface is above the water surface when the auxiliary hull section is in the water-line.

It will be clear to a person skilled in the art that the aspect of an auxiliary hull section positioned above a lower hull section can be regarded independent from the aspect of the lower height of the vessel as claimed in claim 1. Therefore, also conventional semi-submersibles may be provided with an auxiliary hull section and configured to be submerged to a third draft. In this way, conventional semi-submersibles may show an improved dynamic behaviour in long swell waves.

In one aspect of the invention, the distance between the underside of the deck structure and the at least one lower hull section is sufficient in order to prevent storm waves hitting the underside of the deck structure with a large force when the at least one lower hull section intersects the water-line. Advantageously, the vessel is designed to ride out a storm in open water, e.g. an ocean, where storms occur having a significant wave height Hs of 16.0 to 17.0 meters at the first draft. Such waves typically occur in the North Atlantic Ocean.

In one aspect of the invention, the distance between the upper side of the at least one lower hull section and the underside of the deck structure is smaller than the significant wave height Hs for storm conditions.

In one aspect of the invention, the distance between the upper side of the at least one lower hull section and the underside of the deck structure is at least 10 meter and less than 20 meter, preferably less than 15 meter. Depending on the significant wave height, these distances are preferred in order to create the ratio of deckload and equipment to displacement of at least 0.15, respectively 0.2.

In one aspect of the invention, the distance between the underside of the deck structure and the at least one lower hull section is sufficient in order to prevent waves of moderate height hitting the underside of the deck structure when the vessel is positioned at the second draft. Said moderate waves may have a significant wave height Hs of 2, 4, 6, 8 or 10 meter.

Preferably, said distance is sufficient to perform:

- crane installation work at a significant wave height Hs of 2 to 4 meter;
- pipelay work at a significant wave height Hs of 3 to 6 meter; and/or
- a drilling operation at a significant wave height Hs of 3 to 10 meters.

Such a distance advantageously allows these operations to be performed under sufficiently stable working conditions.

In one aspect of the invention, a width of the deck structure is at least 10% larger than a width of the at least one lower hull section, preferably 20% larger, more preferably 25% larger. If there are several lower hull sections positioned adjacent one another, the width of the deck structure may be at least 10% larger than the distance between the left side of a left lower hull section and the right side of a right lower hull section.

An increased width advantageously provides an increased working deck area for a same width of the at least one lower hull section.

In one aspect of the invention, a width of the support structure increases in an upward direction over at least a part of the height of the support structure. This allows the support structure to support the deck structure over a substantial part of the width thereof, preferably over the entire width.

In one aspect of the invention, the bow of the vessel and/or stern of the vessel has a rounded form for allowing a relatively smooth flow of water along the vessel during transport. Such a bow/stern also reduces the cross-sectional area of the hull at the water-line and thereby increases the natural heave period of the vessel at the second draft, reducing heave motions.

In one aspect of the invention, a length of the vessel is at least twice the width of the vessel. This ratio of width to length has shown to enable a high speed, while providing sufficient workspace on deck. The length of the at least one lower hull section may be at least twice the width of the at least one lower hull section and/or twice the width of the deck structure.

In one aspect of the invention, the vessel further comprises a propulsion system for propelling the vessel, preferably being configured to propel the vessel at a speed of the vessel of at least 20 knots. A self-propelled semi-submersible advantageously is capable of conducting an operation without the assistance of a tugboat or other vessel.

In one aspect of the invention, the deck structure comprises reinforcement means configured for providing strength to the deck structure for allowing incoming waves to exert high forces on the deck structure. A reinforced deck advantageously enables the distance between the deck structure and the vessel to be smaller.

In one aspect of the invention, the auxiliary hull section comprises reinforcement means configured for providing strength to the auxiliary hull section, such that the auxiliary hull section is capable of withstanding forces due to storm waves hitting the auxiliary hull section.

In one aspect of the invention, the ballast system is configured for rapid water ballast displacements to control the heel and trim of the vessel during lifting or setting of a crane load. This substantially prevents the pull out of vertical alignment of the crane load, effecting in unwanted horizontal force on a crane boom.

Such a ballast system may comprise a chamber and a large movable piston, wherein the piston is configured to rapidly vary the amount of water held in the chamber. It is also possible to ballast the vessel using pressurised air or by pumps for pumping water into and out of the ballast tanks or tanks above water having large valves allowing quick dumping of water.

The ballast system may advantageously control the draft and/or heel and trim of the vessel, in particular in response to loads which induce a sudden shift of the centre of gravity of the vessel.

In one aspect of the invention, the ballast system is configured for controlling the heel, trim or draft of the vessel in response to weight shift from cargo or load on-board the vessel. The ballast system is controlled by a computer, which receives input data from sensors which measure the orientation of the vessel, the force exerted on the crane, and/or other parameters. Advantageously, the vessel can be held substantially upright under varying loads, from operational loads, e.g. from a lifting operation. Typically, within one minute an induced variation of the heel, trim or draft of the vessel due to an external load may be compensated for by the ballast system.

In one aspect of the invention the lower hull section comprises two lower hull parts defining a space in between the two lower hull parts. This embodiment provides an advantage of a wider hull having an increased stability.

In one aspect of the invention the vessel comprises a left lower hull part and a right lower hull part, said space being provided between the left and right lower hull part. This type of vessel has a good dynamic behaviour of the vessel in waves when lower hull parts are submerged.

In one aspect of the invention, damping means are provided near an underside of the deck structure, for damping the force of a wave hitting the underside of the deck structure.

The damping means provide an advantage in that the distance between the underside of the deck structure and the upper side of the lower hull section may be further decreased. The damping means may be regarded as a technical improvement which is independent from the structural reinforcements and the lower height of the support structure, i.e. the damping means may be applied in any other semi-submersible.

The damping means comprise at least one cavity having an opening at a bottom end thereof, the cavity configured for causing air in the cavity to be compressed by an incoming wave, thereby dampening the force of the wave on the underside of the deck structure. Preferably, a plurality of such cavities are provided.

This is a simple and effective way of damping the wave forces

The invention further relates to a method for operating a vessel, the method comprising providing a vessel comprising:

at least one lower hull section;

a support structure connected to the at least one lower hull section and extending upward from the at least one lower hull section;

a deck structure connected to the support structure, wherein the deck structure is provided at a distance above the at least one lower hull section for providing a clearance between the deck structure and the at least one lower hull section for reducing forces of waves hitting the vessel;

a ballast system for controllably varying the draft of the vessel such that at a first draft the at least one lower hull section may be provided at least in part above the water-line and at a second draft the support structure may be provided at least partly below the water-line;

wherein the assembly of said at least one lower hull section, said support structure and said deck structure is sufficiently strong, such that when the vessel is positioned at the first draft the vessel can substantially safely survive a storm with an amount of deckload and/or equipment equal to at least 0.15 times the displacement, the method comprising positioning the vessel at the first draft.

The method advantageously allows the vessel to survive a storm at the first draft with a substantial amount of cargo on board.

In one aspect of the invention, the vessel comprises a auxiliary hull section provided at a distance above the lower hull section, wherein the vessel is positioned at a third draft at which the auxiliary hull section is partly above the water-line and partly below the water-line.

This method provides an advantage in that the auxiliary hull section provides additional stability to the vessel for allowing a very heavy weight to be lifted eccentrically.

The invention is explained in more detail in the text, which follows with reference to the drawing, which shows a number of embodiments, which are given purely by way of non-limiting examples.

BRIEF DESCRIPTION OF THE DRAWINGS

FIG. 4 shows a schematic side elevation view of a semi-submersible vessel according to the invention;

FIG. 5 shows a schematic cross-sectional view from above of the vessel according to the invention taken at the line A-A in FIG. 4;

FIG. 6 shows a schematic cross-sectional front view of the vessel according to the invention at the line B-B in FIG. 4;

DETAILED DESCRIPTION OF PREFERRED EMBODIMENTS

Figures 1, 2, 3:
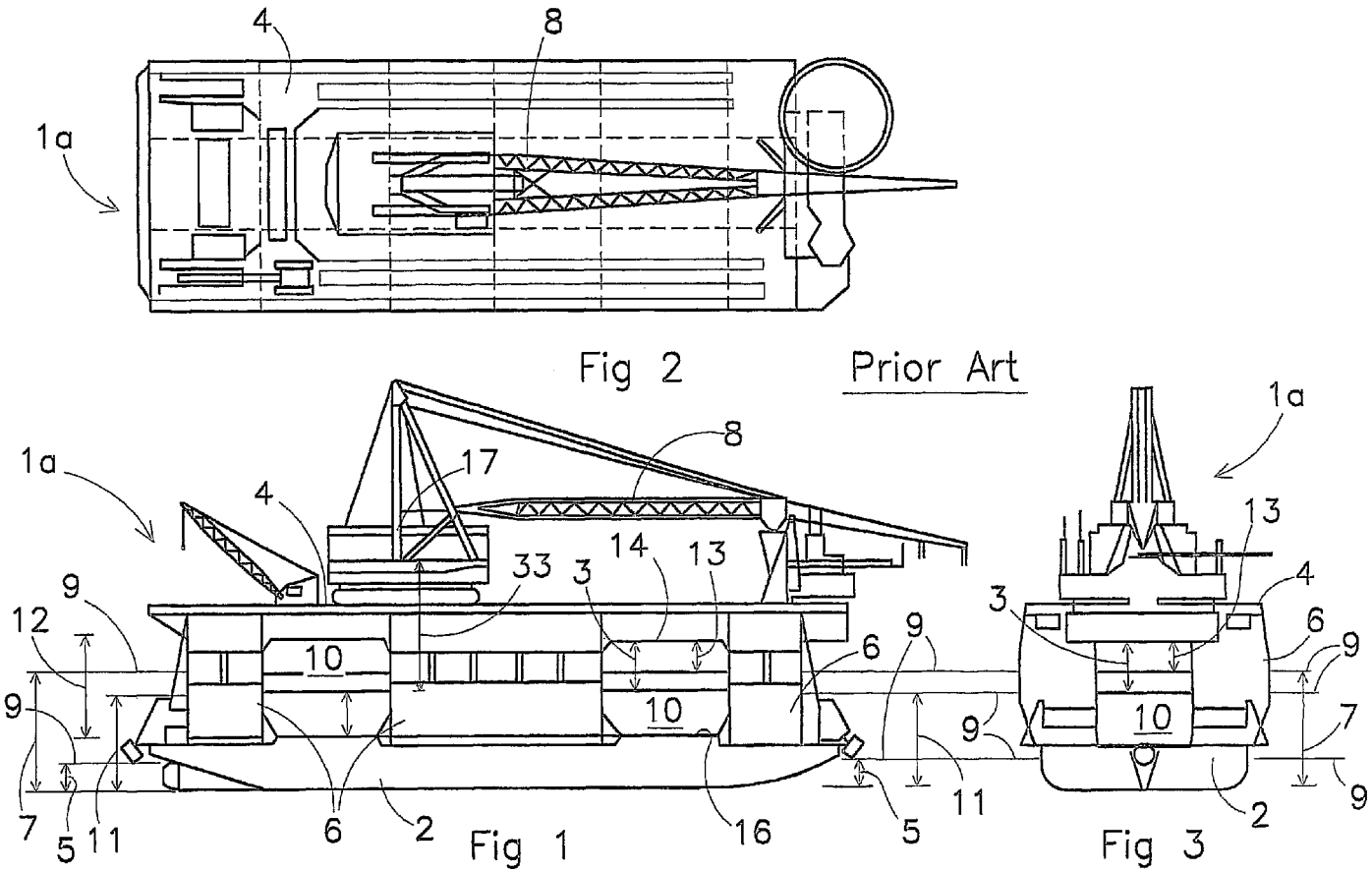
Fig 2 Prior Art
FIG. 1 shows a schematic side view of a semi-submersible vessel according to the prior art.
FIG. 2 shows a schematic top view of a semi-submersible vessel according to the prior art.
FIG. 3 shows a schematic cross-sectional view of a semi-submersible vessel according to the prior art.

With reference to FIGS. 1-3, a vessel 1*a* according to the prior art is shown, the vessel being disclosed in NL 7 907 448A and OTC3296 Narwhal. The semi-submersible vessel 1*a* comprises a lower pontoon 2, a support structure 6 and an upper deck 4, which is supported by the support structure 6. A crane 8 is provided on the upper deck 4. The vessel 1*a* further comprises a ballasting device (not shown) configured for varying the draft and/or control the heel and trim of the vessel 1*a*.

Between the lower pontoon 2 and the upper deck 4, openings 10 are provided in the support structure 6 for allowing waves to pass, thereby reducing forces from the waves on the vessel 1*a*.

The deck 4 has an underside 14, and the pontoon 2 has an upper side 16. The underside 14 of the deck structure is positioned at a distance 12 from the upper side 16 of the pontoon 2. This distance is relatively large.

The crane 8 that is positioned on the deck 4 has a centre of gravity 17, which is located relatively high at a height 33 above the water-line 9 at the storm draft 11.

In survival condition, i.e. during a storm, the lower pontoon 2 stays well below the water-line 9. At this shallow draft 11, also called survival draft 11, the underside 14 of the deck 4 has a sufficient clearance 3 from the water-line 9 to prevent storm waves from hitting and damaging the deck 4.

For a transit condition, the vessel 1*a* is ballasted to the transit draft 5, at which draft the pontoon 2 is positioned partly above the water-line 9, to reduce the sailing resistance of the vessel 1*a*.

During an operation, the operational draft 7 is chosen such that the support structure 6 is partly below, and partly above the water-line 9, whereby the lower pontoon 2 of the vessel 1*a* is ballasted deeper below the water-line 9 than during a storm condition to further reduce the wave forces on the pontoon 2 and to further reduce the vessel's motions.

At this operational draft 7, the underside 14 of the deck 4 has a sufficient clearance 13 from the water-line 9 to substantially prevent waves hitting the deck 4 resulting in increased the vessel motions. Because the waves are lower during an operation than during a storm, the operational clearance 13 can be smaller than the storm clearance 3.

The vessel 1*a* is designed to survive a storm with the pontoon 2 positioned well below the water-line 9, i.e. during a storm the upper side 16 of the pontoon 2 is at a substantial distance 19 below the water-line 9.

With reference to FIGS. 4, 5 and 6, a vessel 20 according to the invention is shown. The vessel 20 comprises a lower hull section 22, a support structure 24 and a deck structure 26. The support structure 24 is connected to an upper side 38 of the at least one lower hull section 22 and to a lower side 40 of the deck structure, thereby supporting the deck structure 26 at a distance 36 from the at least one lower hull section 22. The at least one lower hull section 22 has a length 47, a width 48 and a height 49. The sides 46 of the hull sections are substantially straight and can be vertical or be slanting.

A propulsion system 32 is provided to propel the vessel 20 and a Dynamic Positioning system (DP-system) using propulsion 32 and/or thrusters 34 is provided to control horizontally the position of the vessel 20 during operations.

As can be seen in FIG. 5, the support structure 24 comprises a plurality of columns 42 extending between the at least one lower hull section 22 and the deck structure 26.

The at least one lower hull section 22 has a keel 44 and a hull 21 with sides 46, extending upwards from the keel 44. The at least one lower hull section 22 can be smoothly shaped, e.g. like the underwater body of high-speed container vessels, or can have a blunt shape for more buoyancy.

In the embodiment shown in FIGS. 4, 5 and 6, a width 50 of the deck structure 26 is larger than a width 48 of the at least one lower hull section 22.

The vessel 20 may have a length of about 70-250 meter, typically about 190 meter and have a width of 20-50 meter of the at least one lower hull section, typically about 45 meter. The width of the deck structure 26 may be 30-80 meter, typically about 70 meter. The height of the vessel from the underside 44 of the lower hull section 22 to the upper side 78 of the deck structure may be 30 meter, depending on the overall dimensions of the vessel 20.

The vessel 20 can be ballasted to different drafts. At the first draft, i.e. the transport and storm draft 30, the at least one lower hull section 22 intersects the water-line 9, providing a storm clearance 31. A freeboard 25 is provided at the storm draft 30, which keeps the upper side of the lower hull section 22 substantially free of water. The transport draft 30 is generally about the same as the storm draft 30.

The transport and storm draft 30 may be about 6-12 meter, typically 8 meter. An operational draft may be about 16-25 meter, typically 22 meter. At the operational draft 28, the support structure 24 intersects the water-line 9, while the at least one lower hull section 22 is completely submerged, thereby providing an under deck clearance 29 for moderate operational wave conditions.

In use, the vessel 20 may carry a deck load 27. Also, equipment, e.g. a crane 8 may be provided on the deck 26. The deck load 27 and the crane 8 have a centre of gravity 23 which is located at a height 33 above the water-line 9 at the storm draft 30.

The at least one lower hull section 2 provides sufficient buoyancy and stability to enable the vessel 20 to ride out a storm at the storm draft 30, in particular in the North Atlantic Ocean. The distance 36 between the deck structure 26 and the at least one lower hull section 22 is smaller than the analogous distance 12 of the vessel 1*a* of the prior art shown in FIGS. 1-3 or the vessel 1*b* shown in FIG. 7. The vessel 20 is thus lower, which results in a lower centre of gravity 23 of a deck load and/or equipment 8*a*, 8*b* positioned on deck. This lower centre of gravity provides the advantage of increased stability, allowing more deck load and/or equipment and hence a higher allowable ratio of deckload and equipment to displacement.

Further, the vessel 20 has a ship-shape hull 21 when positioned at the transport draft 30, which allows a high maximum transport speed.

At the transport draft 30, the hull 21 of the vessel 20 has a small wet surface area, causing a relatively small friction force.

The vessel 20 of FIGS. 4, 5 and 6 is relatively long, the length 49 being more than twice a beam 48 of the at least one lower hull section 22. This allows a relatively high speed of the vessel 1. A speed at the transport draft 30 of the shaped hull 21 is in the range of 14 to 25 knots, depending on the thrust power of the propulsion system 32.

The vessel 20 in FIGS. 4 and 5 has a closed bow 59 and an open stern 61. Alternatively, an open bow 59 and/or closed stern 61 may be provided. Transverse bulkheads may be provided in order to increase the strength of the at least one lower hull section 22, the support structure 24 and/or the deck structure 26.

The vessel 20 is constructed as a box-like construction, as shown in FIG. 6, which provides a large strength of the vessel 20. The lower hull section 22 connects a part 41A of the support structure provided at a port side of the vessel with a part 41B of the support structure provided at the starboard side of the vessel. The at least one lower hull section provides a sufficient stability and buoyancy to the vessel 20 to survive storms with the vessel at storm draft 9.

The support structure 24 has a relatively small waterplane area in comparison with the waterplane area of the at least one lower hull section 22.

The support structure 24 has an open structure for allowing a flow of water through the support structure 24, and to increase the natural period of roll, pitch and heave of the vessel 20.

The ballast system 35 is configured for controlling the heel, trim and draft of the vessel 20, in particular when a load is applied to the vessel 20 which causes inclining of the vessel about a horizontal axis. Optionally the ballast system 35 is configured to substantially automatically control the position and orientation of the vessel, in particular in response to loads which induce a shift of the centre of gravity of the vessel due to an operation. The ballast system is formed by ballast tanks in the floaters, columns and/or deck structure, which may controllably be filled with water or emptied.

In one embodiment, ballast tanks may be provided which extend substantially vertically through the lower hull section, through the support structure and into the auxiliary hull section. The ballast tanks in the lower hull section, support structure, and/or the auxiliary hull section may also be separate.

Optionally, the ballast tanks can have special means, such as large valves as shown in U.S. Pat. No. 4,207,828 or air pressure or pistons described in GB2156758 or other methods for displacing quickly large volumes of water, for a rapid response to a fast load change, e.g. during a heavy lift.

Figure 7:
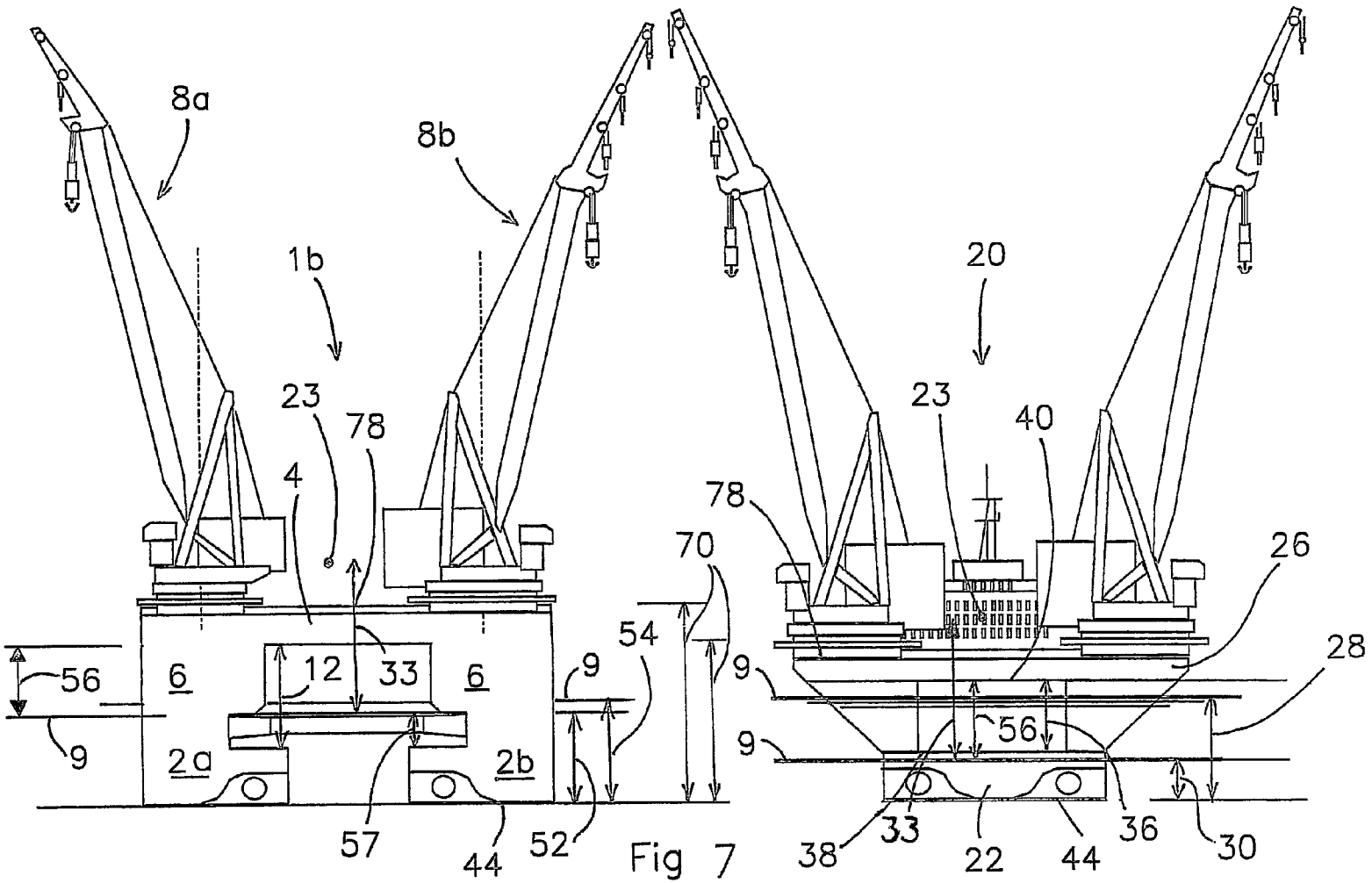
FIG. 7 shows a schematic side view of the vessel according to the prior art and the vessel according to the invention at different drafts.

FIG. 7 shows a comparison of another known vessel 1*b* and the vessel 20 according to the invention. The semi-submersible vessel 1*b* according to the prior art comprises two lower hull parts 2*a*, 2*b* extending substantially parallel to one another. Two cranes 8*a*, 8*b* are provided on the deck 4. The known vessel 1*b* has a storm draft 52 with the lower hull parts 2*a*, 2*b* being submerged at a substantial depth 57 below the water-line. At the storm draft 52, the underside 14 of the deck structure 4 is positioned at a distance 56 relatively high above the water level 9. The shown clearance (or air gap) 56 from the underside 14 of the deck structure 4 to the water-line 9 at a storm draft 52 (also known as survival draft), is required to prevent waves hitting the underside 14 of the deck structure 4 with a too high force.

The vessel 20 according to the invention has an operational draft 28 and a storm draft 30. The storm draft 30 is substantially smaller than the storm draft 52 of the known vessel 1*b*.

The distance 36 between the at least one lower hull section 22 and the deck 26 is considerably smaller than the analogous distance 12 vessel 1*b* of the prior art.

The known vessel 1*b* and the vessel 20 according to the invention may have a same lifting capacity for lifting a load with the crane 8*a*, 8*b*, at which lifting capacity the vessel 20 according to the invention can have a smaller height 70 between the underside 44 of the at least one lower hull section 22 and the upper side 78 of the deck. This causes a lower centre of gravity of cargo positioned on deck and equipment, such as the cranes 8*a*, 8*b*, which causes a more favourable ratio of the allowable deckload and equipment to displacement. In other words, the smaller vessel 20 of the invention may carry a same amount of weight as a relatively larger vessel 1*a*, 1*b* according to the prior art.

Figure 8A:
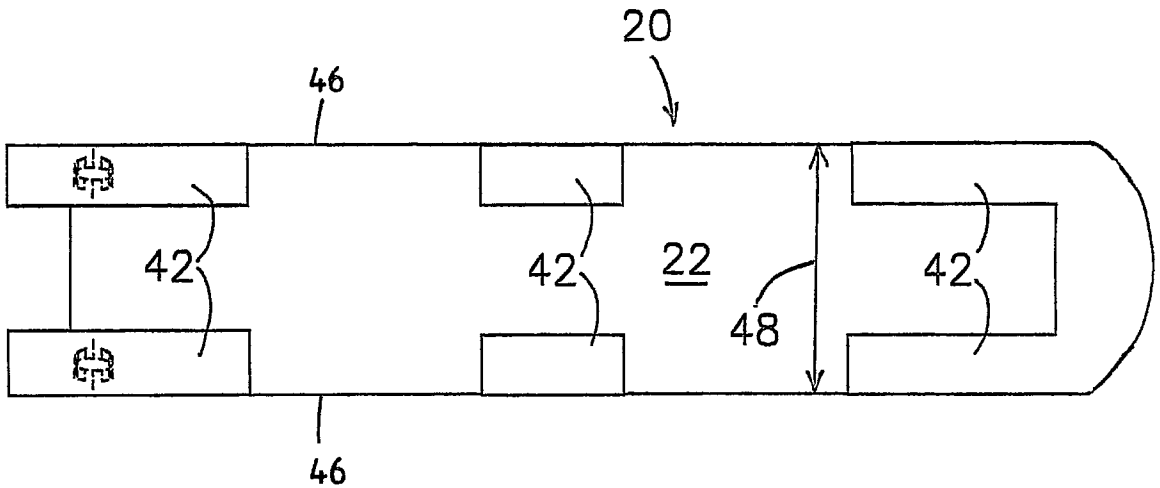
FIG. 8*a* shows a cross-sectional view from above of the vessel according to the invention.
Figure 8B:
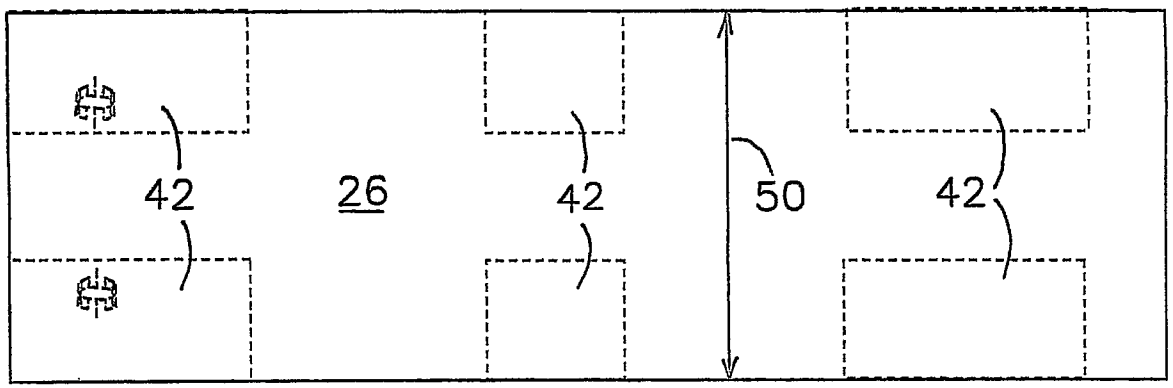
FIG. 8*b* shows a schematic top view of the vessel according to the invention.

With reference to FIGS. 8*a* and 8*b*, the vessel 20 according to the invention has multiple columns 42 of different sizes and has preferably a large work-deck 26. The work-deck 26 extends horizontally beyond the lateral limits of the at least one lower hull section 22. In particular the width 50 of the deck 26 is larger than the width of the at least one lower hull section 22.

The width of the deck structure 26 may typically be about 80 meter, while the width of the at least one lower hull section may typically be 45 meter.

Figures 9A, 9B:
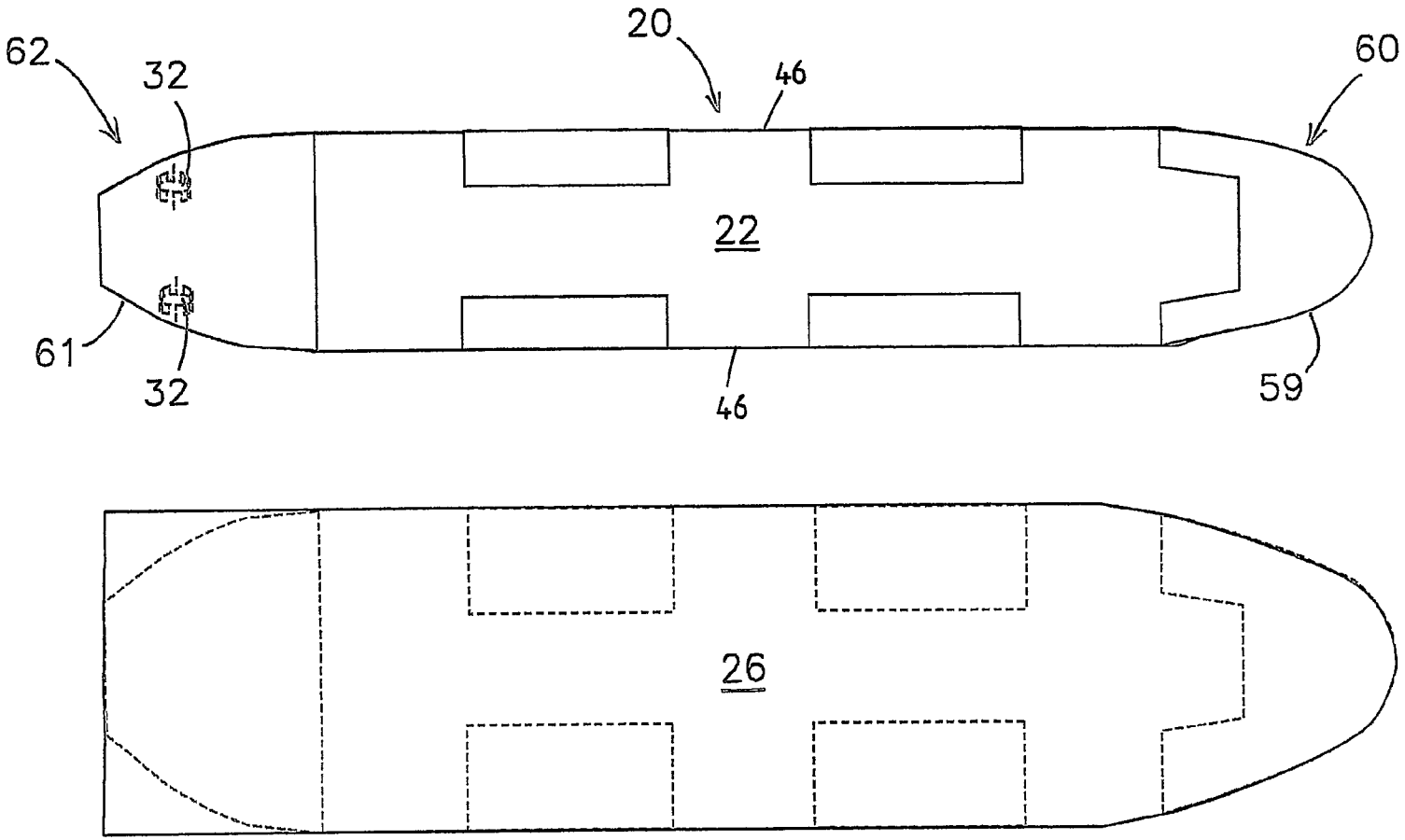
FIG. 9*a* shows a cross-sectional view from above of another embodiment of the vessel according to the invention.
FIG. 9*b* shows a schematic top view of another embodiment of the semi-submersible vessel according to the invention.

With reference to FIGS. 9*a* and 9*b*, the vessel 20 may have a bow 59 having a rounded bow shape 60 and a stern 61 having a rounded stern shape 62 and which are configured for allowing water to flow past it smoothly. This reduces turbulence and provides a substantially laminar flow around the hull 21 as much as possible. This enables a relatively high speed of the vessel 20.

As can be seen in FIG. 9*b*, the deck structure 26 extends beyond the shape 62 of the stern.

Figures 10A, 10B:
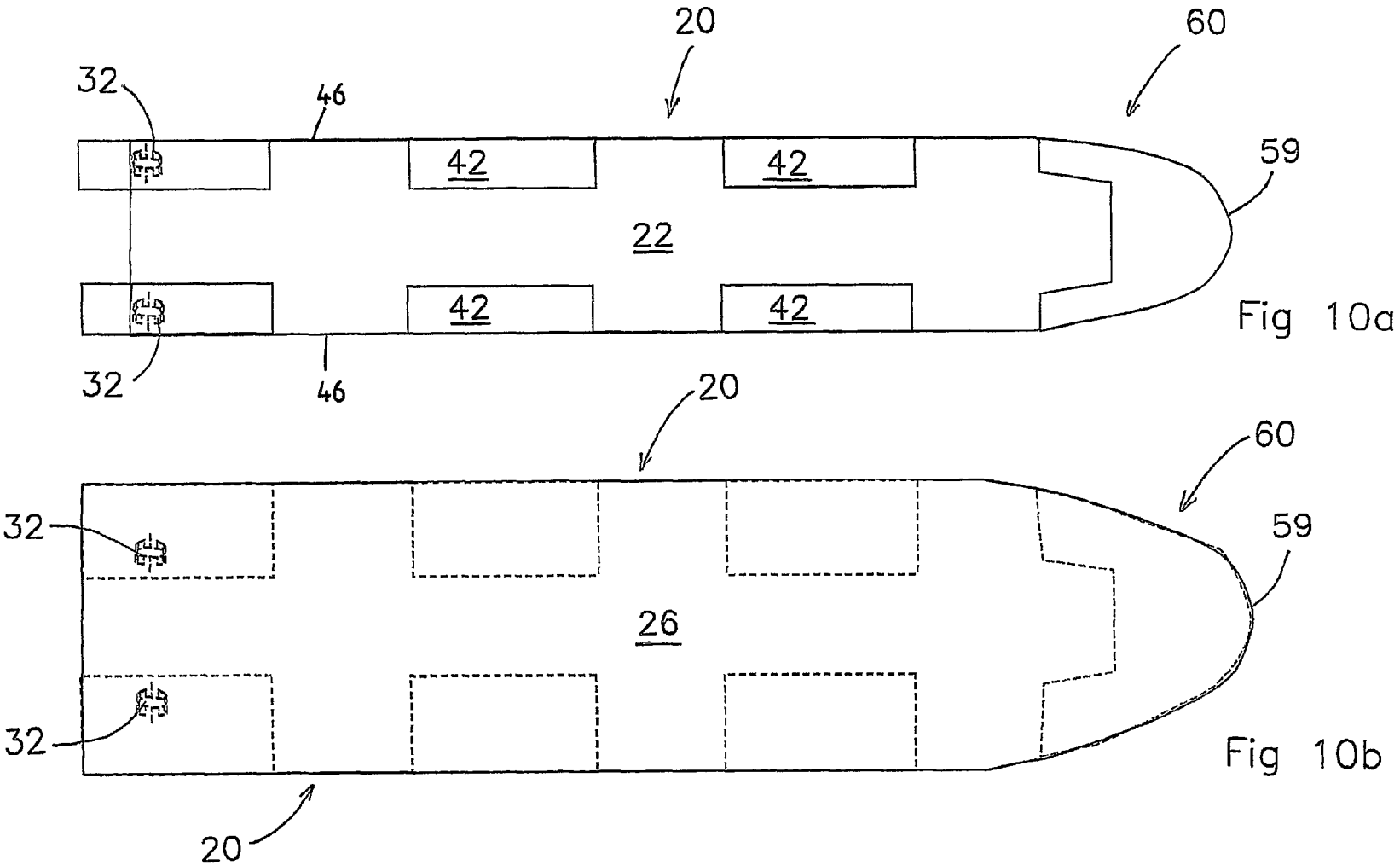
FIG. 10*a* shows a cross-sectional view from above of another embodiment of the semi-submersible vessel according to the invention.
FIG. 10*b* shows a schematic top view of another embodiment of the semi-submersible vessel according to the invention.

With reference to FIGS. 10*a* and 10*b*, it is also possible to only provide the bow 59 with a rounded form 60.

With reference to FIGS. 11, 12, 13, 14 and 15, different embodiments of the vessel 20 of the invention are shown.

Figures 11, 12, 13, 14, 15:
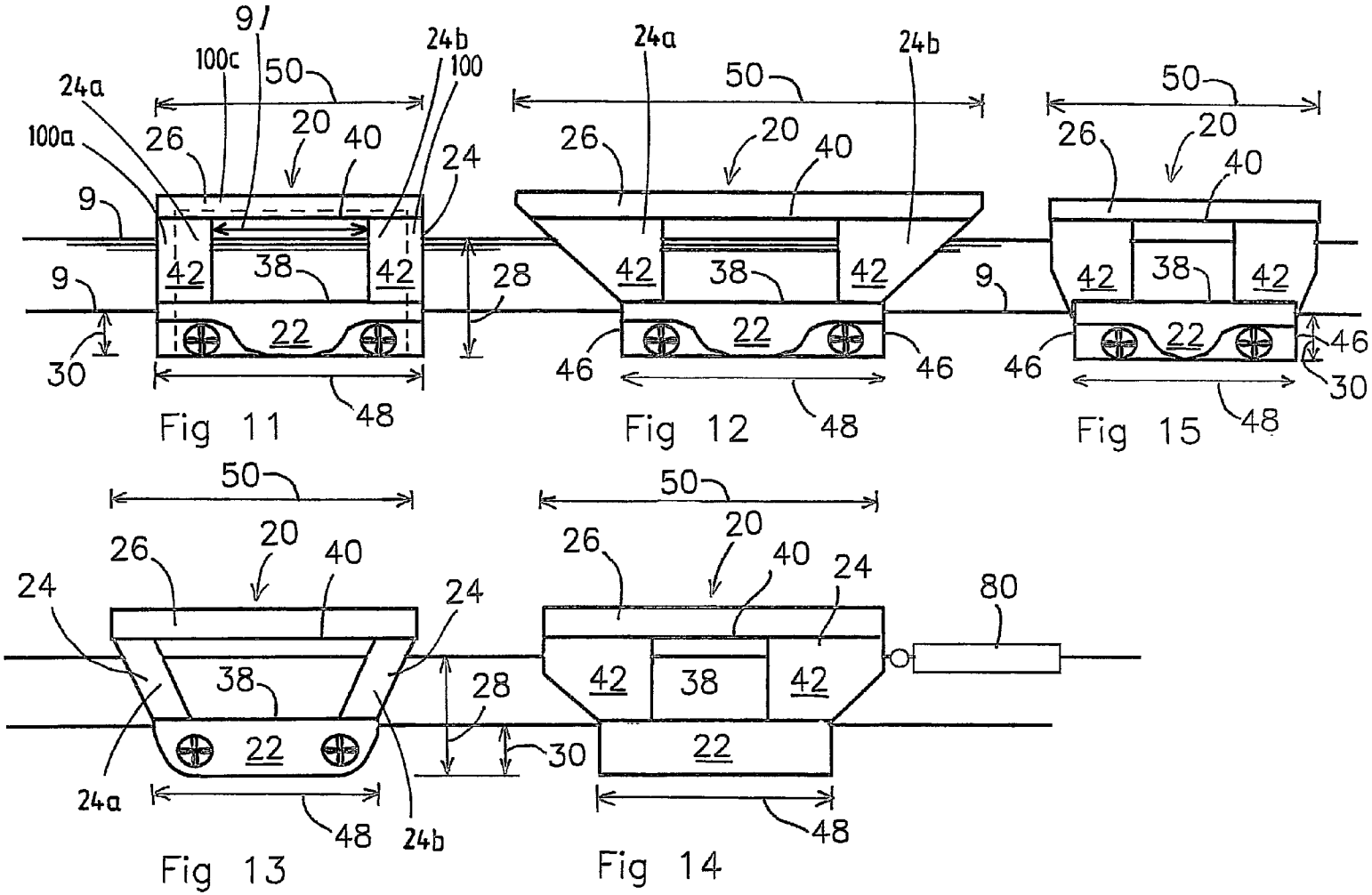
FIGS. 11, 12, 13, 14 and 15 show schematic cross-sections taken from the rear of different embodiments of the vessel according to the invention.

FIG. 11 shows a vessel 20 having a deck structure 26 having a same width 50 as the width 48 of the at least one lower hull section 22. FIG. 12 shows a deck structure 26 having a width 50 which is substantially larger than the width 48 of the at least one lower hull section 22, i.e. 100% larger. the hull 21 having a support structure 24, which tapers outwardly in an upward direction. The width 48 of the support structure 24 thus increases in an upward direction. The outwardly tapering support structure 24 is configured to enlarge waterplane area for increasing drafts to derive good stability at operational draft, allowing e.g. heavy lifts.

The support structure 24 comprises a left part 24*a* and a right part 24*b* positioned at a distance 97 from one another.

FIG. 13 shows a vessel 20 having a wide deck structure 26. The support structure has a width 50 which increases in an upward direction, but has a substantially constant waterplane area at different drafts, when the water-line 9 is at the level of the support structure 24. Optionally, the at least one lower hull section 22 is shaped for a minimal resistance during transit.

FIG. 14 shows a vessel 20 having a support structure 24 comprising columns 42 which are partly slanting, but are vertical in the waterline 9 at the operational draft 28 in order to ease the mooring of a barge 80 at the operational draft 28.

FIG. 15 shows a semi-submersible with one pontoon, having a storm draft 30 at which the at least one lower hull section 22 is in part above the water-line 9.

Other forms of the at least one lower hull section 22, the support structure and the upper deck may also be possible.

Figure 16:
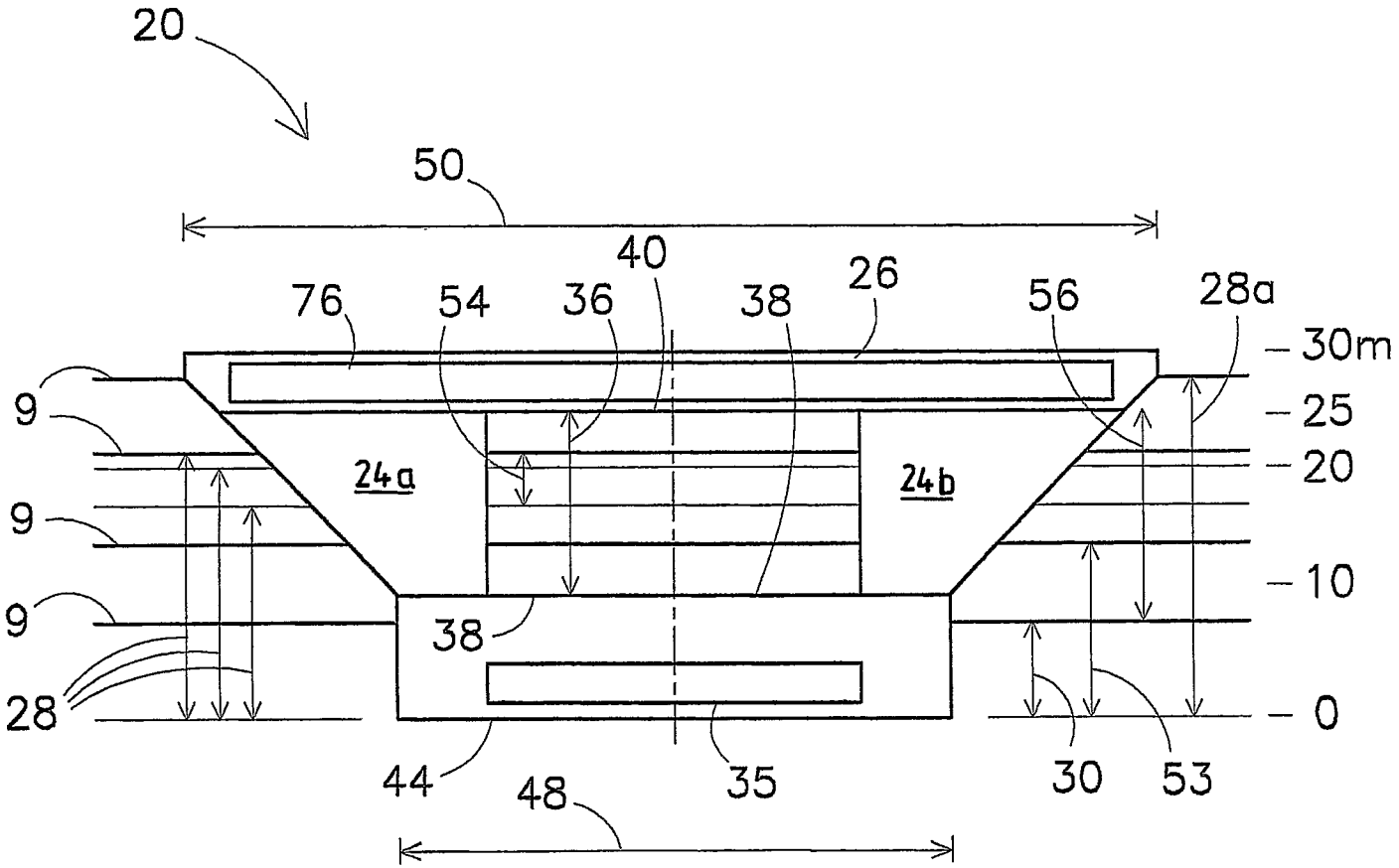
FIG. 16 shows a schematic cross-section taken from the rear of the vessel according to the invention at different drafts.

FIG. 16 shows possible drafts of the vessel 20 according to the invention. A storm draft 30 (also known as survival winter draft) is the draft at which the vessel 20 can survive a winter storm. Equipment such as cranes, pipelay equipment etc. and cargo positioned on the deck structure 26 has to be safely secured in order to survive storm waves. The storm draft 30 is depending on the height of the at least one lower hull section 22, but preferable with a freeboard to the top of the at least one lower hull section of 0.5 to 2.0 m or more.

A second storm draft 53, called summer storm draft, is shown. The summer storm draft 53 is larger than the storm draft 30, with the water-line 9 above the upper side 38 of the at least one lower hull section 22 in the survival summer draft 53 in order to reduce motions of the vessel 20 in waves. This is allowable, because the waves will be smaller than the waves during a winter storm. At a typical summer storm draft 53 there is 1 to 7 meter water above the at least one lower hull section.

In practice, the vessel 20 will be ballasted in storm conditions to a relatively deep draft to reduce vessel motions, but with a sufficient wave clearance to the deck.

A number of operational drafts 28 are shown. At the operational draft 28 equipment such as cranes, pipelay equipment etc. can be in an operable position. A range of operational drafts 54 is possible, depending on the conditions and the type of operation to be performed. A typical operational draft 28 may be 14-22 meter.

The vessel 20 may have an auxiliary hull section 76 (or pontoon) positioned at a substantially same level as the deck structure 26. A third operational draft 28*a* with the auxiliary hull section 76 partly below the water-line 9 is also possible. The vessel 20 may be positioned at this draft 28*a* in order to provide extra waterplane area and stability during an operation for heavy load operations, i.e. pulling an anchor from the seabed or heavy lift operations. It can also be an advantage to operate at this deep draft 28*a* in case very long swells excite the vessel natural periods at smaller drafts, resulting in large motions.

Figures 17, 18, 19:
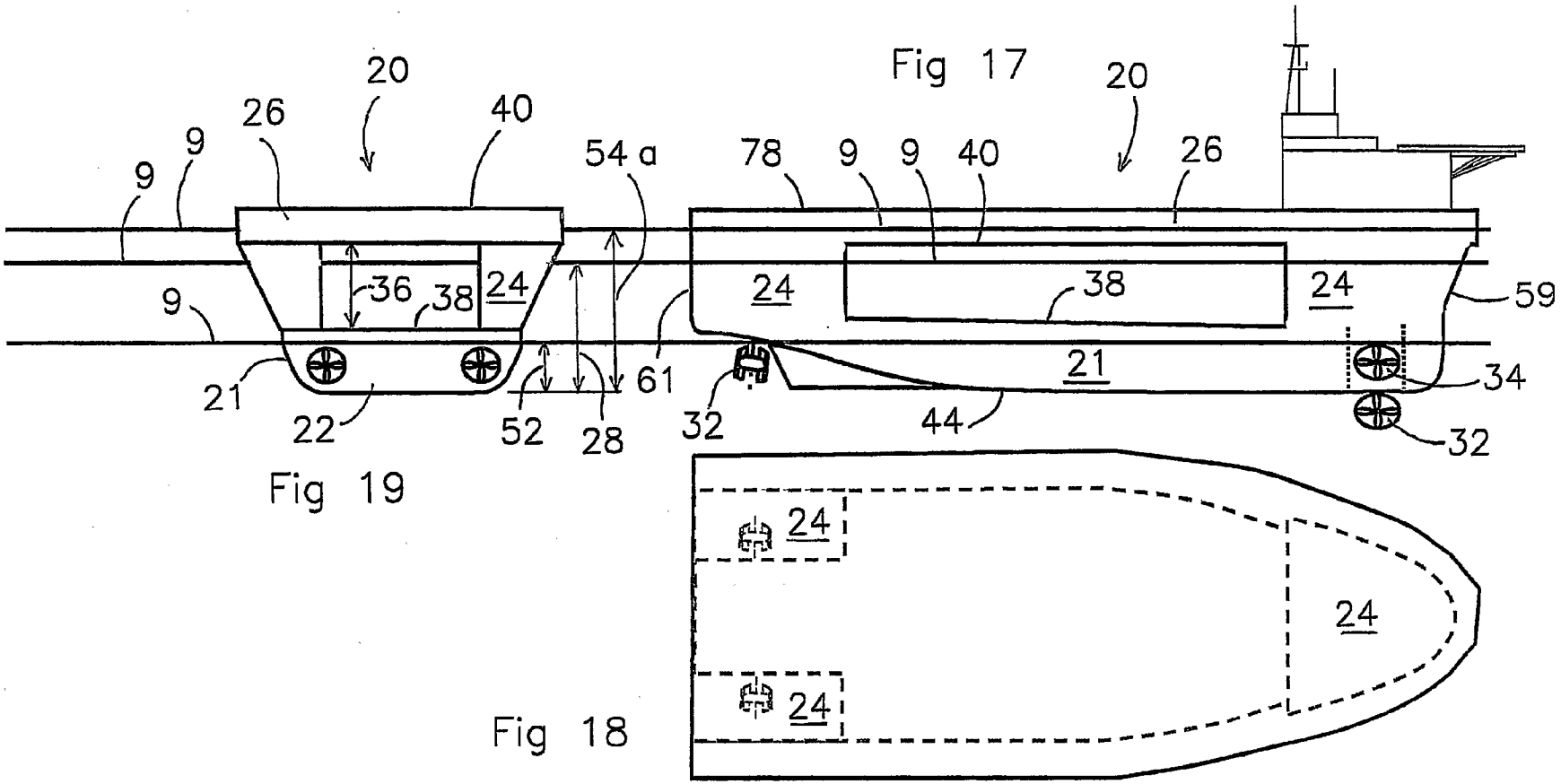
FIG. 17 shows a schematic side elevation view of another embodiment of the vessel according to the invention.
FIG. 18 shows a schematic cross-section from above of another embodiment of the vessel according to the invention.
FIG. 19 shows a schematic cross-sectional view of another embodiment of the vessel according to the invention.

FIGS. 17, 18 and 19 show a vessel 20 according to the invention, in which the vessel 20 is configured as a relatively small semi-submersible vessel or as a support vessel. Typical dimensions of this embodiment are: an overall length (LOA) of 80 m; a width of the at least one lower hull section 22 being 25 meter; a width of the deck structure 26 of 35 meter and a distance between upper side of the at least one lower hull section 22 to the lower side 40 of the deck structure 26 being 17.5 meter. These dimensions may vary.

FIGS. 20A, 20B, 20C, 20D 21 and 22 show a further embodiment of the vessel 20 according to the invention. The vessel has a hull which in some aspects resembles a known form of known semi-submersibles. The lower hull section 22 comprises two lower hull parts, a left lower hull part 22*a* and a right lower hull part 22*b*, defining a space 43 in between. The sides 46 of the hull sections are substantially straight and can be vertical or slanting.

Figure 22:
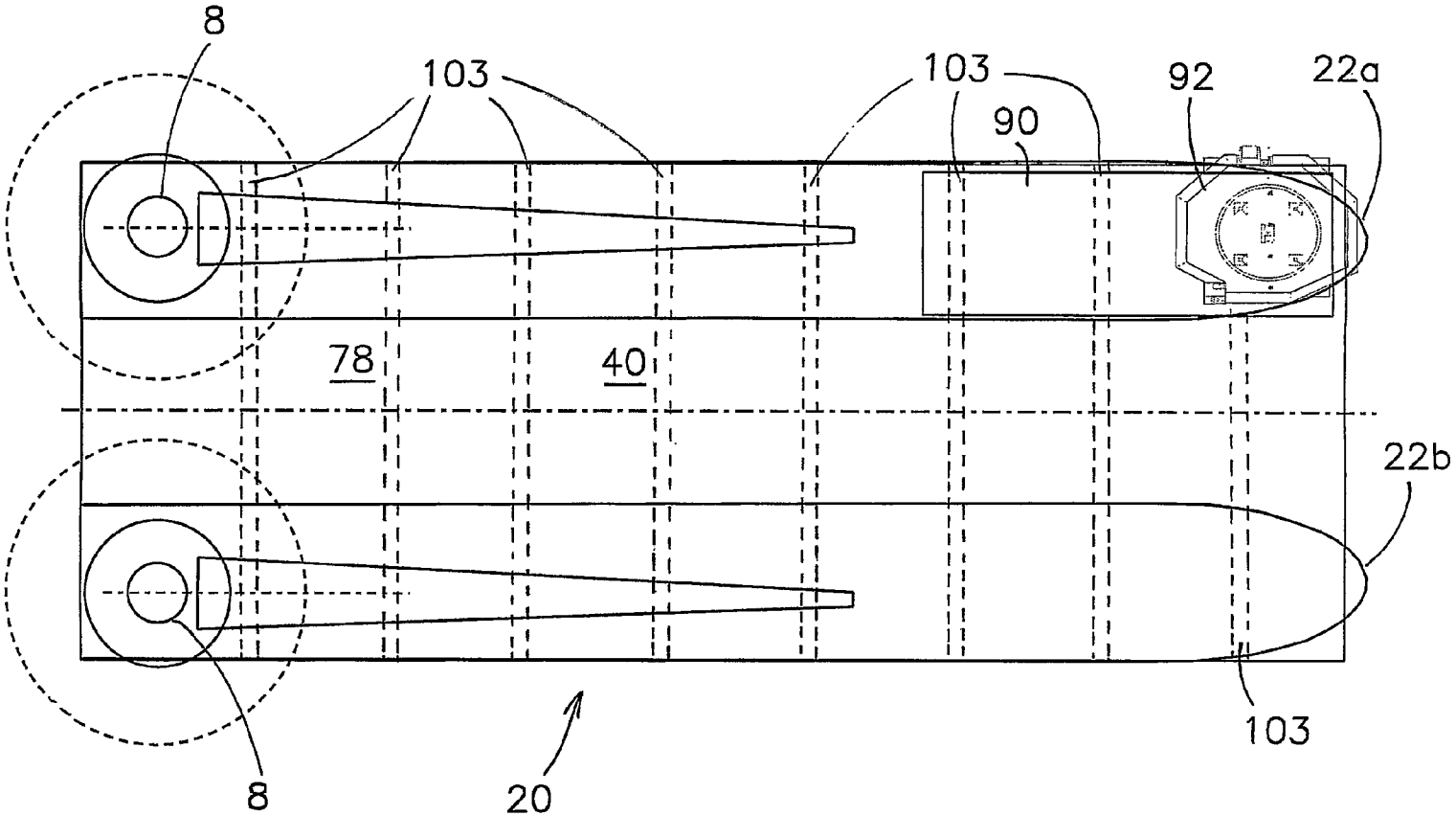
FIG. 22 shows a schematic top view of the embodiment of FIG. 20.

The vessel 20 comprises a deck structure 90 positioned on deck 78, which can house equipment or personnel. In FIG. 22, a position of a control bridge 92 is indicated.

In the shown embodiment, the left lower hull part 22*a* and the right lower hull part 22*b* are connected with one another via the support structure 24 and the deck structure 26. It is also possible that one or more strengthening rods (not shown) extend directly between the lower hull parts 22*a*, 22*b*, for strengthening the hull.

The vessel 20 differs from known vessels in that the distance 36 between the upper side 38 of the lower hull section 22 and the lower side 40 of the deck structure is smaller than in known vessels, such that the vessel 20 is stable enough to ride out a storm at the first draft 30.

The lower hull section 22 is stronger than the flotation bodies of known semi-submersibles such that it is capable of withstanding the forces of storm waves hitting the vessel 20 at the first draft 30 (or storm draft).

Two left vertical beams 100*a*1 and 100*a*2 and two right vertical beams 100*b*1 and 100*b*2 extend from the bottom side 44 of the lower hull sections 22*a*, 22*b* toward and into the deck structure 26.

Two lateral beams 100*c*1 and 100*c*2 extend laterally, connecting the left vertical beams 100*a* to the right vertical beams 100*b*.

The vertical beams 100*a* and 100*b* form a portal 103 together with the two lateral beams 100*c*1 and 100*c*2.

Figure 20A:
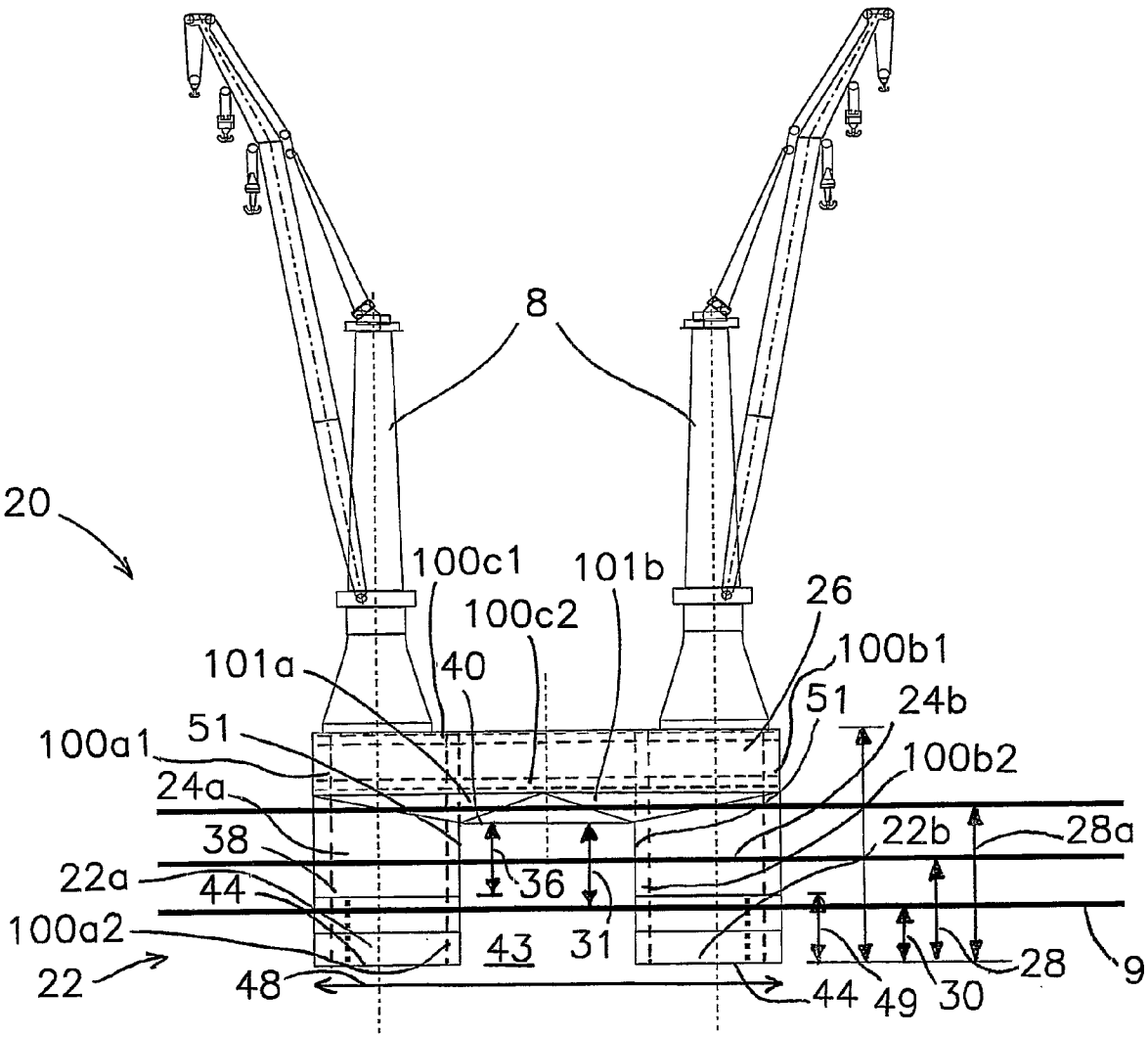
FIG. 20A shows a schematic rear view of another embodiment of the vessel according to the invention.
Figure 20B:
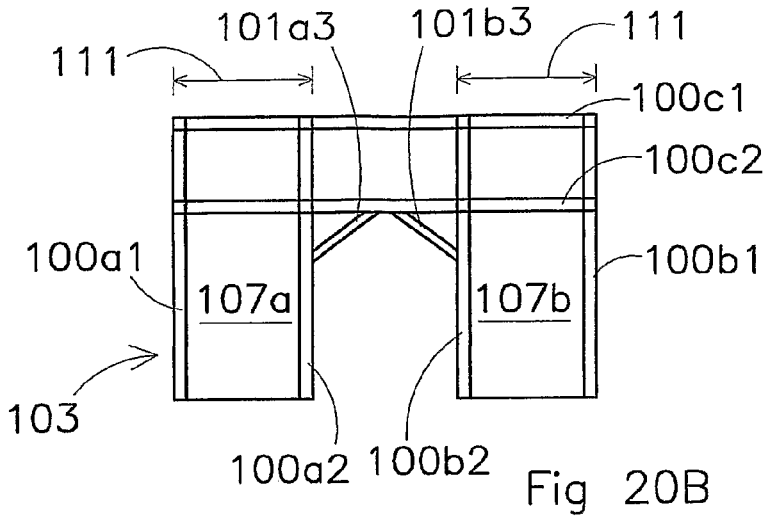
FIGS. 20B, 20C and 20D show schematic views of a reinforcement portal for strengthening the hull of the vessel.

FIG. 20*b* shows a portal 103 formed by the respective beams. A plurality of portals may be provided on the vessel, spaced apart from one another in the longitudinal direction of the vessel.

Further, reinforcement arms 101*a*3, 101*b*3 have been applied in order to more strongly connect the support structure to the deck structure. The reinforcement arms 101*a*3, 101*b*3 protrude laterally from the inner sides 51 of the support structure and are rigidly connected to the lower side of the deck structure.

It is also possible, that the left part 24*a* of the support structure and the right part 24*b* of the support structure are provided in the form of beams which extend from the lower hull section to the deck structure, wherein said beams have a width which is substantially equal to the width of the left part 24*a* respectively the right part 24*b* of the support structure 24 itself.

In this embodiment, as can be seen in FIG. 20B, elements 107*a* forms a body (or web) of the beam, and elements 100*a*1, 100*a*2 form flanges of said beam. Analogously, element 107*b* is a body of a right beam.

Figure 20C:
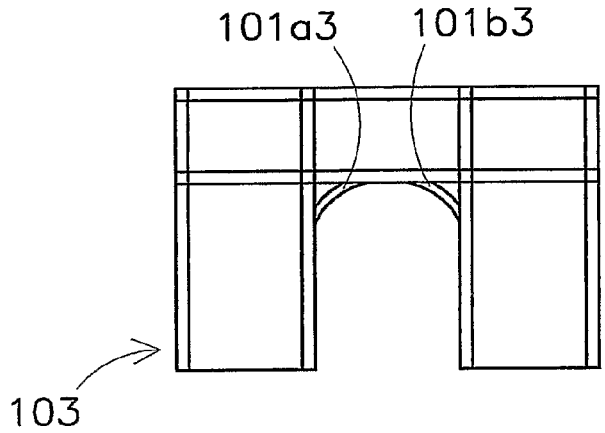

As FIG. 20*c* shows, the beams or local braces 101*a*3, 101*b*3 may be rounded.

Figure 20D:
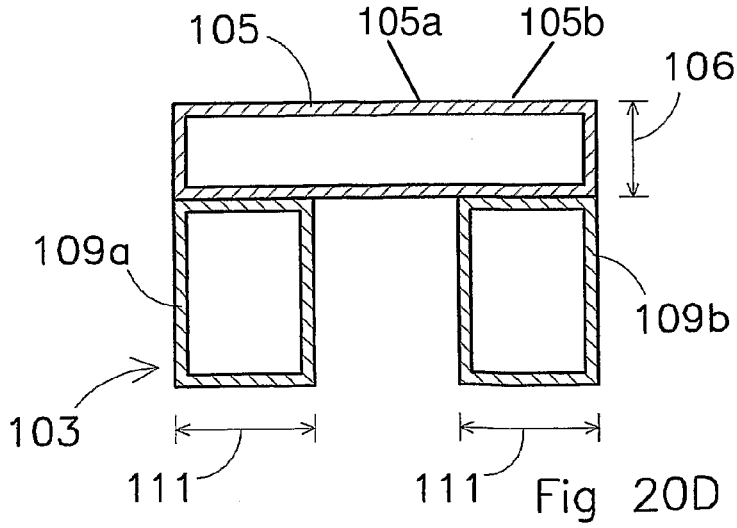
Figure 21:
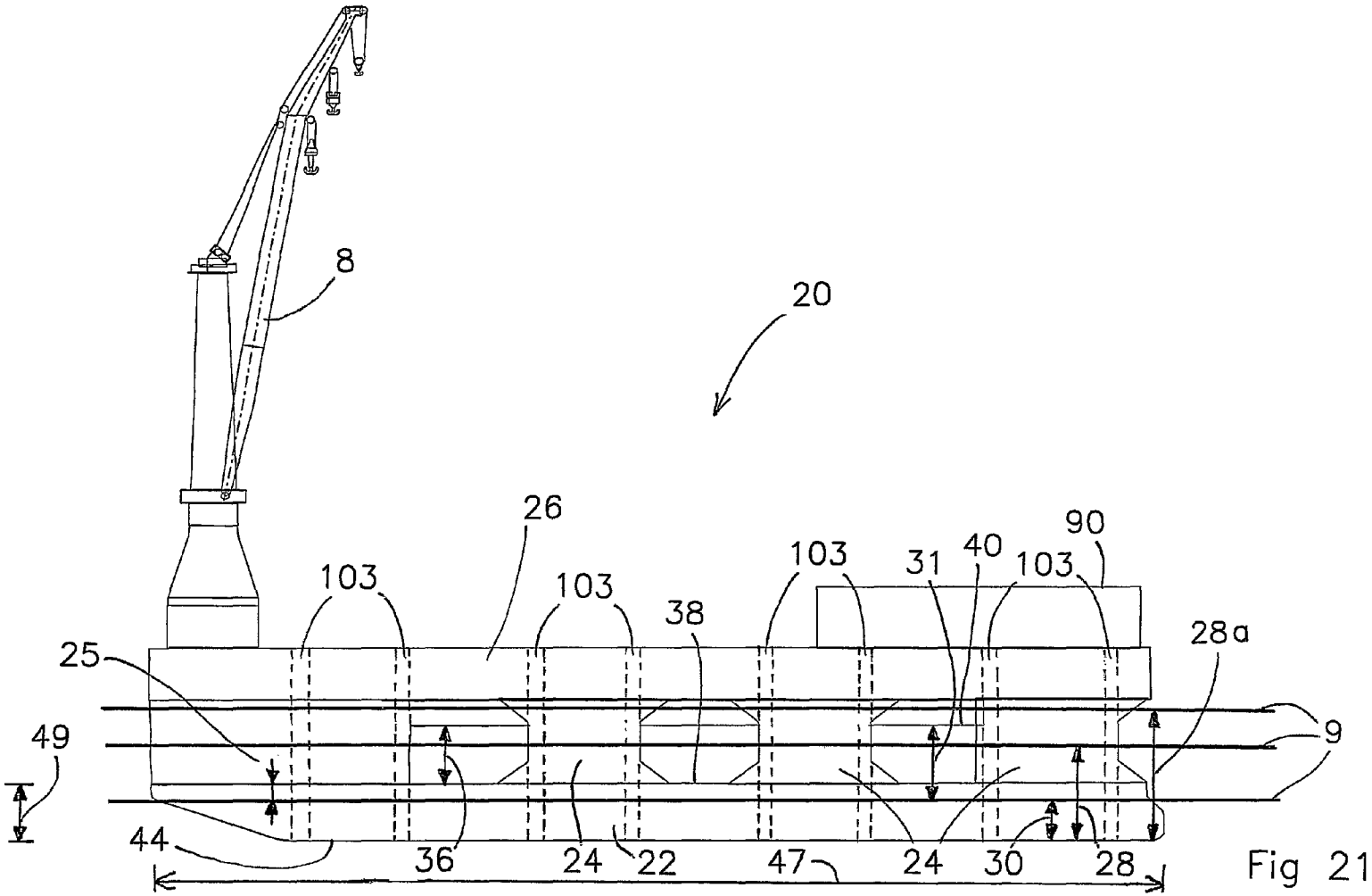
FIG. 21 shows a schematic side view of the embodiment of FIG. 20.

FIG. 20D shows that a deck part 105 of the portal 103 may also comprise a box girder 105*a*, preferably spanning the full height 106 of the deck structure 26.

It is possible that the left part 24*a* and the right part 24*b* of the support structure 24 are provided in the form of box girders 109*a*, 109*b* which have a width 111 which is substantially equal to the width of the left part 24*a* and the right part 24*b* of the support structure 24.

The support structure 24 is rigidly connected to the lateral beams 101*c*1, 101*c*2 or the box-like beam 105*b* in order to withstand splitting forces which result from a different load on the left and right lower hull section 22*a*, 22*b* and which urge the left lower hull section 22*a* to move, i.e. translate or rotate, relative to the right lower hull section 22*b*.

Figure 23:
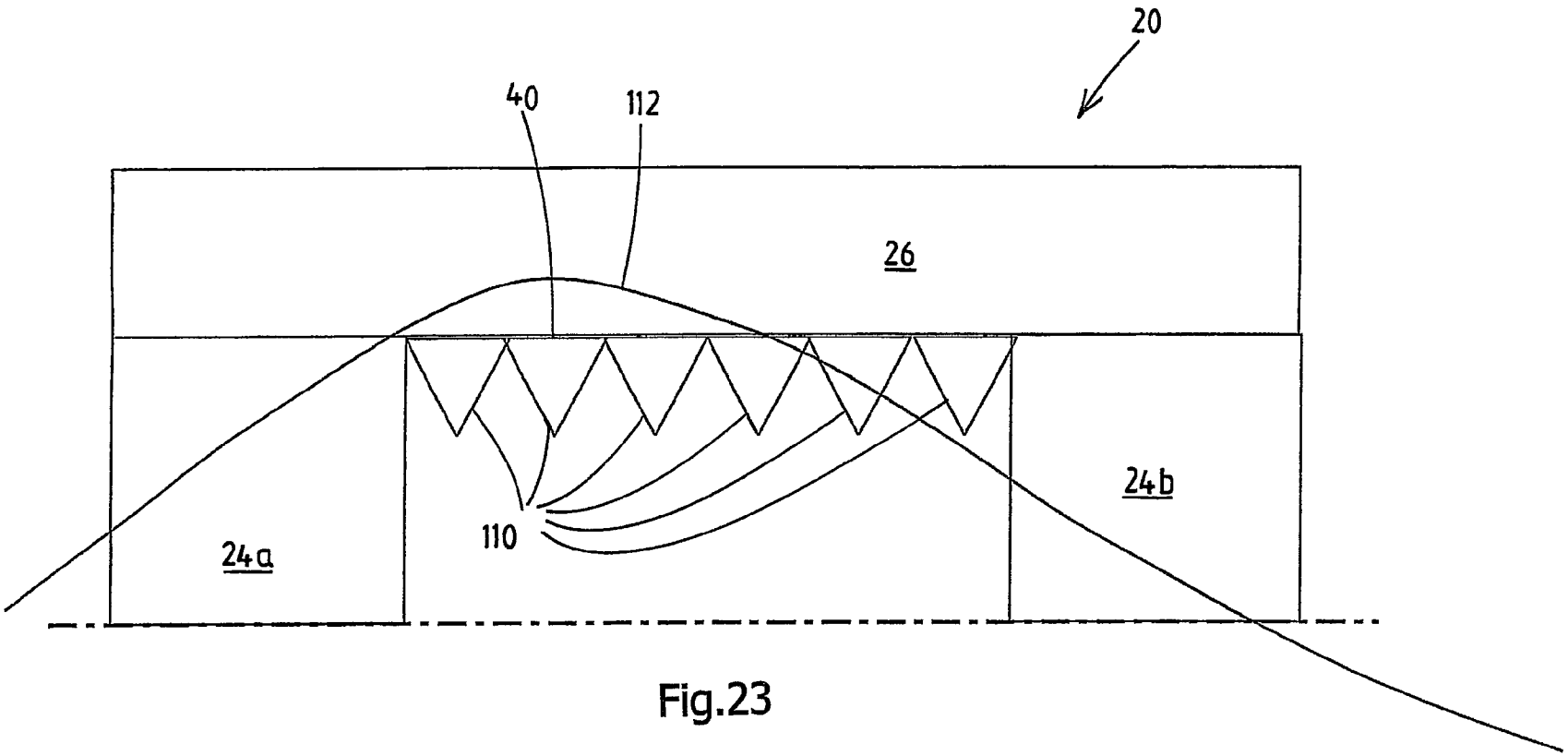
FIGS. 23 and 24 show schematic cross-sectional views of the vessel according to the invention provided with wave slamming reduction means.
Figure 24:
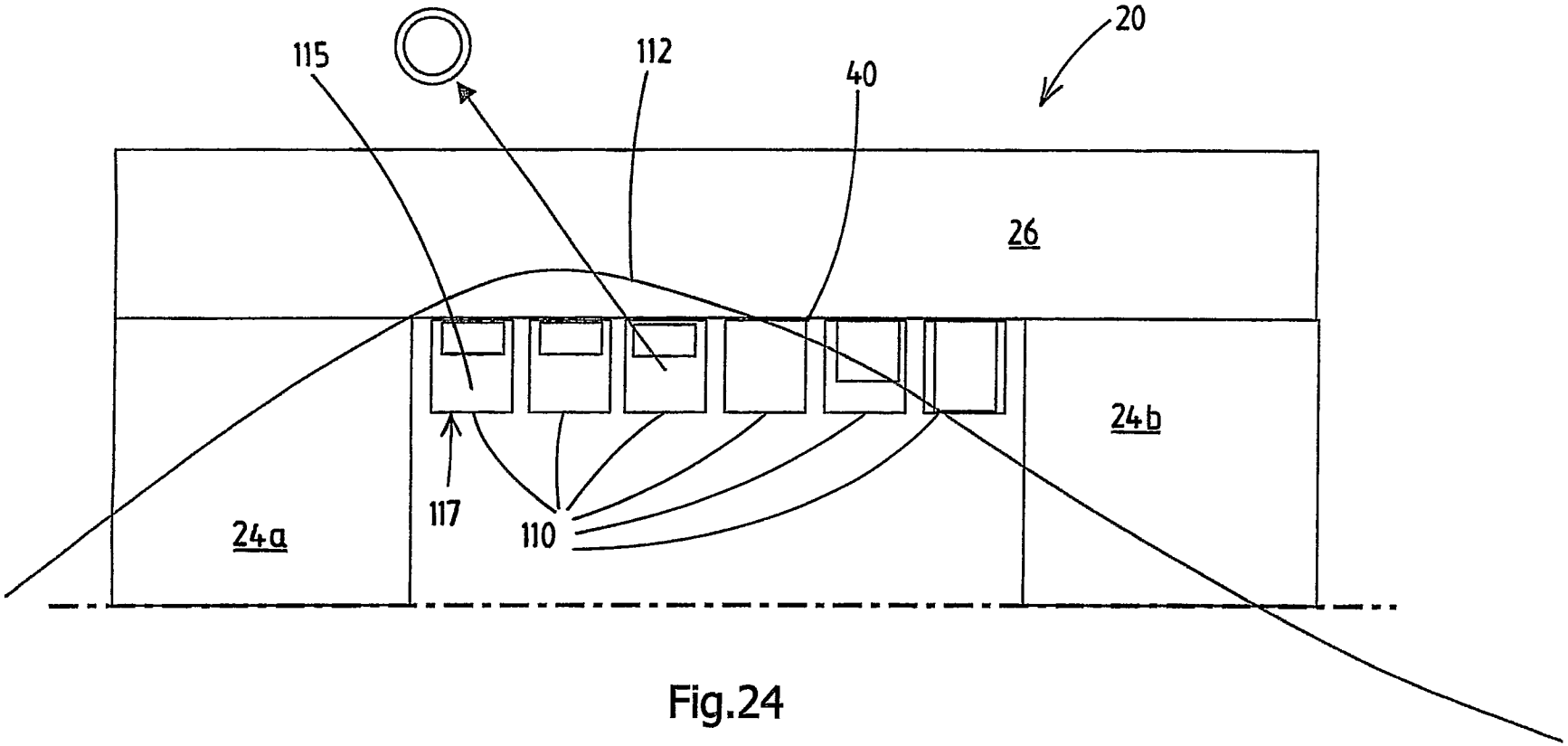

FIGS. 23 and 24 show possible damping means in the form of wave slam reduction means 110 provided near the underside 40 of the deck structure 26. The slam reduction means are configured to retain air which is compressed by the water and thus serves as a cushion for the force of the wave 112 hitting the underside of the deck structure.

In FIG. 23, the slam reduction means are triangular and in FIG. 24, they are pipe shaped. Any other form capable of retaining air that can serve as a cushion, or any other means suitable to serve as a cushion is also possible.

The wave slamming reduction means absorb a substantial part of the kinetic energy of the waves, reducing the impact on the deck structure.

It will be obvious to a person skilled in the art that numerous changes in the details and the arrangement of the parts may be varied over considerable range without departing from the spirit of the invention and the scope of the claims.

What is claimed is:

1. An autonomous, self-propelled semi-submersible vessel comprising:

at least one lower hull section which defines a first water displacing volume, the at least one lower hull section comprising a propulsion system and a dynamic positioning system using propulsion and/or thrusters to control horizontal positioning of the autonomous, self-propelled semi-submersible vessel;

a support structure connected to the at least one lower hull section and extending upward from the at least one lower hull section wherein the support structure has a waterplane area which is smaller than the waterplane area of the at least one lower hull section;

a deck structure connected to the support structure, wherein the deck structure is provided at a distance above the at least one lower hull section; and a ballast system for controllably varying the draft of the vessel;

wherein the vessel is designed and constructed to be operated at a number of different predescribed drafts which are specified for that vessel, the predescribed drafts comprising:

an operational draft for carrying out an operation, a transit draft for travelling large distances, and a survival draft for surviving a storm;

the semi-submersible vessel having structural reinforcements configured for operation of the semi-submersible vessel at the survival draft, in which survival draft the at least one lower hull section of the semi-submersible vessel is partly above a waterline.

2. The vessel of claim 1, wherein the distance between the upper side of the at least one lower hull section and the deck structure is more than 12 meter, and less than 18 meter.

3. The vessel of claim 1, wherein the vessel comprises no more than one lower hull section, said lower hull section configured as a single body.

4. The vessel of claim 1, wherein a width of the deck structure is at least 10% larger than a width of the at least one lower hull section.

5. The vessel of claim 1, wherein a width of the support structure increases in an upward direction over at least a part of the height of the support structure.

6. The vessel of claim 1, wherein the lower hull section comprises two lower hull parts defining a space in between the two lower hull parts.

7. The vessel of claim 6, the vessel comprising a left lower hull part and a right lower hull part, said space being provided between the left and right lower hull part, which left and right lower hull parts are located on opposite sides of a vertical plane intersecting the center of gravity of the vessel along a length of the vessel.

8. The vessel of claim 7, wherein the structural reinforcements comprise at least one strengthening portal, the at least one strengthening portal comprising:

a left portal part extending upwards from the left lower hull part toward the deck structure, a right portal part extending upward from the right lower hull part toward the deck structure, and a deck part extending laterally near the deck structure and connected to the left and right portal parts, wherein the left and right portal parts are located on opposite sides of a vertical plane intersecting the center of gravity of the vessel.

9. The vessel of claim 3, wherein the structural reinforcements comprise at least one rigid strengthening portal for strengthening the vessel, the portal rigidly connecting the lower hull section, the support structure and the deck structure to one another.

10. The vessel of claim 9, wherein the at least one strengthening portal comprises at least two vertical beams extending from one side of a bottom side of the at least one lower hull section and at least two vertical beams extending from an opposite side of the bottom side of the at least one lower hull section, and at least two lateral beams extending laterally connecting the vertical beams on each side, which side and opposite side of the at least one lower hull section are on opposite sides of a vertical plane intersecting the center of gravity of the vessel.

11. The vessel of claim 1, wherein the support structure comprises columns having a sidewall, wherein a sidewall of each column is directly connected to a sidewall of the deck structure and to a sidewall of the lower hull section.

12. The vessel of claim 1, wherein the vessel is capable of conducting an operation without assistance of a tugboat or other vessel.

13. A method for operating an autonomous, self-propelled semi-submersible vessel, the method comprising:

providing a vessel comprising at least one lower hull section which defines a first water displacing volume, the at least one lower hull section comprising a propulsion system and a dynamic positioning system using propulsion and/or thrusters to control horizontal positioning of the autonomous, self-propelled semi-submersible vessel;

a support structure connected to the at least one lower hull section and extending upward from the at least one lower hull section, wherein the support structure has a waterplane area which is smaller than the waterplane area of the at least one lower hull section;

a deck structure connected to the support structure, wherein the deck structure is provided at a distance above the at least one lower hull section; and a ballast system for controllably varying the draft of the vessel;

the method further comprising:

varying a draft of the vessel for positioning the vessel at an operational draft for carrying out an operation, varying a draft of the vessel for positioning the vessel at a transit draft for traveling large distances, and, during a storm varying a draft of the vessel for positioning the vessel at a survival draft for surviving the storm;

wherein at the operational draft the support structure is at least partly below a waterline;

wherein at the transit draft the at least one lower hull section is in part above the waterline;

wherein at the survival draft the lower hull section is in part above the waterline;

wherein the semi-submersible vessel comprises structural reinforcements for surviving the storm at said survival draft.

14. The method of claim 13, wherein said storm has waves having a significant wave height Hs of 16 to 17 meter.

15. The method of claim 13, further comprising: conducting an operation without assistance of a tugboat or other vessel.

* * * * *